US005731115A

United States Patent [19]

Kato et al.

[11] Patent Number: 5,731,115

[45] Date of Patent: Mar. 24, 1998

[54] METHOD FOR PREPARATION OF WATERLESS LITHOGRAPHIC PRINTING PLATE BY ELECTROPHOTOGRAPHIC PROCESS

[75] Inventors: Eiichi Kato; Akio Oda, both of Shizuoka, Japan

[73] Assignee: Fuji Photo Film Co., Ltd., Kanagawa, Japan

[21] Appl. No.: 653,945

[22] Filed: May 22, 1996

[30] Foreign Application Priority Data

May 23, 1995 [JP] Japan ..... 7-123845

[51] Int. Cl.[6] ..... G03G 13/28

[52] U.S. Cl. ..... 430/49

[58] Field of Search ..... 430/49, 126

[56] References Cited

U.S. PATENT DOCUMENTS 4,645,729 2/1987 Honda et al. ..... 430/126
5,501,929 3/1996 Kato et al. ..... 430/49

FOREIGN PATENT DOCUMENTS 49-121602 11/1974 Japan .
3-118154 5/1991 Japan .

*Primary Examiner*—John Goodrow
*Attorney, Agent, or Firm*—McAulay Fisher Nissen Goldberg & Kiel, LLP

[57] ABSTRACT

A method for preparation of a waterless lithographic printing plate by an electrophotographic process comprising forming a non-fixing toner image by an electrophotographic process using a liquid developer on a surface of an electrophotographic light-sensitive element comprising an electrically conductive support having provided thereon a photoconductive layer, transferring the toner image onto a support for lithographic printing plate, providing a non-tacky resin layer having adhesion to a surface of the support for lithographic printing plate larger than adhesion between the toner image and the surface of the support for lithographic printing plate on the whole surface of the support for lithographic printing plate bearing the toner image, and removing the non-tacky resin layer provided on the toner image.

The method is suitable for a scanning exposure system using a laser beam of a low power, and simply and rapidly provides a lithographic printing plate excellent in image qualities and printing durability.

18 Claims, 1 Drawing Sheet

METHOD FOR PREPARATION OF WATERLESS LITHOGRAPHIC PRINTING PLATE BY ELECTROPHOTOGRAPHIC PROCESS

FIELD OF THE INVENTION

The present invention relates to a method for preparation of a waterless lithographic printing plate by an electrophotographic process. More particularly, it relates to a method for preparation of a waterless lithographic printing plate including an electrophotographic toner image-forming step to which method a scanning exposure using a laser beam having a low power can be applied. The method provides a lithographic printing plate excellent in image qualities and printing durability.

BACKGROUND OF THE INVENTION

In general, lithographic printing involves a step of applying water to a hydrophilic non-image areas of a printing plate to prevent adherence of oily printing ink and a step of feeding oily printing ink to oleophilic image areas of the printing plate. However, maintaining of the delicate balance between the amount of water applied to the plate and the amount of ink fed to the plate is difficult and needs a skilled worker.

In order to overcome these problems of conventional lithography, waterless lithographic printing plates capable of printing in the absence of dampening water have been provided. Waterless lithographic printing plates have oil repellant areas and oleophilic areas. Oily ink is applied to the plate and adheres only to the oleophilic areas and an ink image thus formed on the plate is transferred to paper. One method practically used comprises imagewise exposing to light a light-sensitive material having a silicone rubber layer and a light-sensitive layer composed of a photosensitive resin to make difference in adhesion between the silicone rubber layer and the light-sensitive layer in the exposed area from the non-exposed areas and removing the imaging areas by a wet development processing to prepare a lithographic printing plate. This method requires contact imagewise exposure using a light source having a short wavelength and a high power due to low-sensitivity of the light-sensitive element and the wet development processing. Therefore, this method has problems in simplicity, rapidness and labor saving and is very difficult to apply to the preparation of lithographic printing plate accepting a recent image-forming system using a digital signal, i.e. a digital direct printing plate.

A system has been commercialized by Heiderberg Co., Ltd. wherein a material comprising a heat-sensitive layer containing a substance capable of converting radiation into heat and a silicon layer provided thereon is subjected to scanning exposure by a laser beam corresponding to a digital signal to destroy the silicon layer together with the heat-sensitive layer using the heat generated in the exposed portion, followed by removing these layers in the exposed portion by a dry development processing thereby providing a waterless printing plate.

According to the system, writing by a laser beam using a heat mode and a dry development processing are employed. However, a laser writing device of high power is necessary because of low sensitivity of the recording material which leads to increase in a size of apparatus, a period of plate-making and a cost of the system.

JP-A-47-19305 (the term "JP-A" as used herein means an "unexamined published Japanese patent application"), JP-A-49-19904, JP-A-59-125752 and JP-A-62-160466 each discloses a method capable of image-forming simply in an apparatus of a small size using an electrophotographic light-sensitive element suitable for scanning exposure by a semiconductor laser beam of a low power. On the electrophotographic light-sensitive element is provided a silicon layer and then an oleophilic toner image is formed thereon by an electrophotographic process to prepare a waterless printing plate.

However, adhesion of the toner image portion to the silicon layer is poor in the printing plate and the image portion is apt to be damaged by tack of ink supplied which results in the occurrence of image failure. Thus a printing durability of the plate is very low.

In order to improve a printing durability there have been proposed methods for increasing adhesion between the toner image portion and the silicon layer. For example, there are a method wherein a unhardened silicone rubber layer is provided and after the formation of toner image, the silicone rubber is hardened as described, for example, in JP-A-50-53110 and JP-A-52-105003, and a method using a reactive group-containing silicon rubber layer as described, for example, in JP-A-52-29305, JP-A-56-83750 and JP-A-57-178893. However, these methods are still insufficient in the adhesion for the practical purpose.

JP-A-49-121602 discloses a method comprising forming an image composed of dry toner on a support for lithographic printing plate by a PPC copying machine such as a laser printer using a semiconductor of low power or a printer of heat-sensitive transfer, providing a silicon layer on the whole surface of the support, hardening the silicon layer and then selectively removing the silicon layer on the image portion upon a wet development processing using a solvent to prepare a printing plate.

Also, JP-A-3-118154 discloses a method comprising forming a light absorber-containing image or a non-adhesive image using dry toner on a support for lithographic printing plate by a PPC copying machine such as a laser printer using a semiconductor of low power or a printer of heat-sensitive transfer, providing a silicon layer on the whole surface of the support, hardening the silicon layer and then selectively removing the silicon layer on the image portion upon a dry development processing using heat or mechanical means to prepare a printing plate.

According to these methods described in JP-A-49-121602 and JP-A-3-118154, poor adhesion of toner image to a silicon layer occurred in the printing plate prepared by forming the toner image on the silicon layer as described hereinbefore can be solved. Further, a simple dry process can be used for removing the silicon layer on the image portion in the method described in JP-A-3-118154.

However, these methods still have problems. Specifically, since adhesion between the silicon layer and the support in the non-image portion is insufficient and releasability of the silicon layer depends on a conversion rate of radiation to heat of a dye or pigment employed, a difference of adhesion between the silicon layer and the support in the non-image portion from adhesion between the image portion and the silicon layer is small in fact. Accordingly, it is difficult to selectively remove the silicon layer on the image portion in fine image regions, particularly by a dry process, and thus these methods are not sufficient for providing constantly good printing plates.

Further, there is a limit to forming a highly accurate image using a PPC copying machine or printer of heat-sensitive transfer as well known in the art and a printing plate having excellent image qualities is hardly obtained.

Recently, a printing system providing prints of highly accurate full color image in a simple, rapid and laborsaving manner including edition in a workstation and digital image processing has been highly desired. However, such a desire cannot be answered by the techniques describe about.

SUMMARY OF THE INVENTION

Therefore, an object of the present invention is to provide a method for preparation of a waterless lithographic printing plate by an electrophotographic process which is suitable for scanning exposure system using a laser beam of a low power and which provides a lithographic printing plate excellent in image qualities and printing durability in a simple, rapid and labor-saving manner.

Another object of the present invention is to provide a method for preparation of a waterless lithographic printing plate by an electrophotographic process which is capable of faithfully reproducing a highly accurate image.

A further object of the present invention is to provide a method for preparation of a waterless lithographic printing plate by an electrophotographic process in which a toner image portion is removable by a dry process and which provides a highly accurate image in a stable manner even when a condition of removing step is fluctuated.

Other objects of the present invention will become apparent from the following description.

It has been found that the above described objects of the present invention are accomplished by a method for preparation of a waterless lithographic printing plate by an electrophotographic process comprising forming a non-fixing toner image by an electrophotographic process using a liquid developer on a surface of an electrophotographic light-sensitive element comprising an electrically conductive support having provided thereon a photoconductive layer, transferring the toner image onto a support for lithographic printing plate, providing a non-tacky resin layer having adhesion to a surface of the support for lithographic printing plate larger than adhesion between the toner image and the surface of the support for lithographic printing plate on the whole surface of the support for lithographic printing plate bearing the toner image, and removing the non-tacky resin layer provided on the toner image.

BRIEF DESCRIPTION OF THE ACCOMPANYING DRAWING

FIG. 1(*a*)–(*e*) is a schematic view for explanation of the method according to the present invention.

Explanation of the Symbols:

1 Support of electrophotographic light-sensitive element

2 Photoconductive layer

3 Toner image

4 Intermediate transfer medium

5 Support for lithographic printing plate

7 Non-tacky resin layer

10 Electrophotographic light-sensitive element

DETAILED DESCRIPTION OF THE INVENTION

Figure 1:
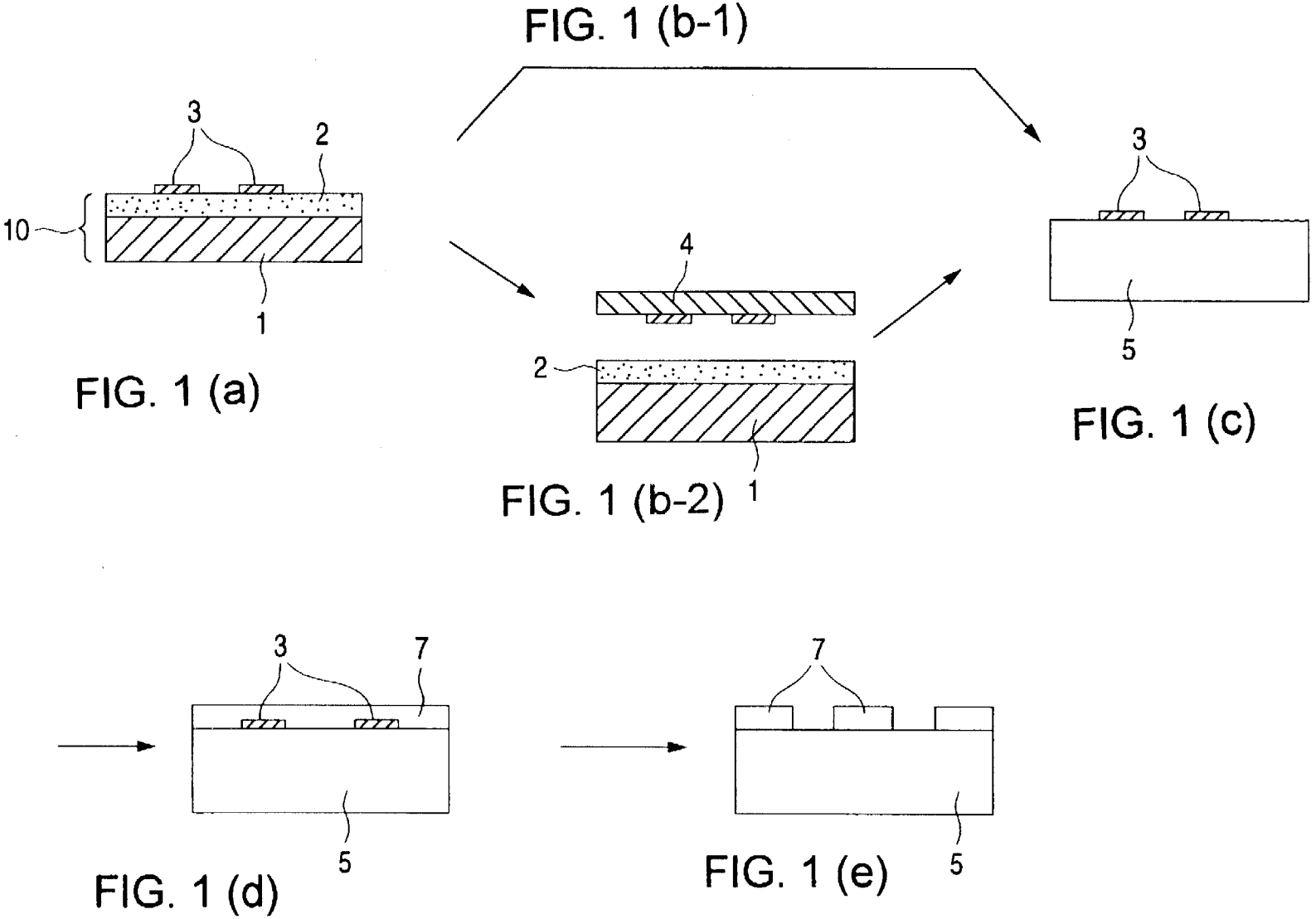

A method for preparation of a waterless lithographic printing plate by an electrophotographic process according to the present invention will be diagrammatically described with reference to FIG. 1 of the accompanying drawing.

As shown in FIG. 1, a non-fixing toner image 3 is first formed by an electrophotographic process using a liquid developer on a surface of an electrophotographic light-sensitive element 10 comprising a support 1 having provided thereon a photoconductive layer 2 in Step (a). The toner image 3 is transferred in non-fixing state onto a support for lithographic printing plate 5 (hereinafter referred to as a final receiving material sometimes) which may optionally have an adhesive layer to form the non-fixing toner image 3 on the support for lithographic printing plate 5 in Step (c). The toner image 3 can be directly transferred onto the support for lithographic printing plate 5 as in Step (b-1) or it is first transferred onto an intermediate transfer medium 4 (hereinafter referred to as a primary receptor sometimes) and then transferred onto the support for lithographic printing plate 5 as in Step (b-2).

On the whole surface of support 5 bearing the toner image 3 is provided a non-tacky resin layer 7 having adhesion to the surface of support 5 larger than adhesion between the toner image 3 and the surface of support 5 in Step (d). Utilizing the difference in adhesion, the non-tacky resin layer provided on the toner image is selectively removed and the non-tacky resin layer 7 remains on the support 5 in the non-image portion to prepare a waterless lithographic printing plate in Step (e).

According to the method of the present invention, since the adhesion between the support for lithographic printing plate and the non-tacky resin layer in the non-image portion is larger than the adhesion between the support and the toner image, even fine image regions are easily and selectively removed. Accordingly, the lithographic printing plate obtained has excellent image qualities and faithful reproduction of highly accurate image can be achieved.

In accordance with the present invention, the non-tacky resin layer is provided on the support for lithographic printing plate, bearing the non-fixing toner image and the adhesion between the support for lithographic printing plate and the non-tacky resin layer is controlled to be larger than that between the toner image and the support.

Specifically, a force necessary for releasing the non-tacky resin layer from the support for lithographic printing plate in the non-image portion (i.e., adhesion between the non-tacky resin layer and the support) is preferably not less than 200 g.f and, on the other hand, a force necessary for removing the non-tacky resin layer from the support for lithographic printing plate in the image portion (i.e., adhesion between the toner image and the support) is preferably not more than 20 g.f. More preferably, the adhesion in the non-image portion is not less than 300 g.f and the adhesion in the image portion is not more than 5 g.f.

Making such a substantial difference in the adhesion of non-tacky resin layer between the non-image portion and the image portion, the non-tacky resin layer on the toner image is selectively removed in the image portion without damaging the non-tacky resin layer in the non-image portion.

Measurement of the adhesion described above is conducted according to JIS Z 0237-1980 8.3.1. 180 *Degrees Peeling Method* with the following modifications:

(i) As a test plate of the non-image portion, a support for lithographic printing plate having a non-tacky resin layer provided thereon is used. As a test plate of the image portion, a support for lithographic printing plate bearing a toner layer electrophotographically formed on the whole surface thereof and having the non-tacky resin layer provided thereon is used.

(ii) As a test piece, a silicon adhesive tape of 25 mm in width (#851A manufactured by Minnesota Mining and Manufacturing Co.) is used.

(iii) A peeling rate is 25 mm/min using a constant rate of traverse type tensile testing machine.

Specifically, the test piece is laid its adhesive face downward on the test plate and a roller is reciprocate one stroke at a rate of approximately 300 mm/min upon the test piece for pressure sticking. Within 20 to 40 minutes after the sticking with pressure, a part of the stuck portion is peeled approximately 25 mm in length and then peeled continuously at the rate of 25 mm/min using the constant rate of traverse type tensile testing machine. The strength is read at an interval of approximately 5 mm in length of peeling, and eventually read 4 times. The test is conducted on three test pieces. The mean value is determined from 12 measured values for three test pieces and the resulting mean value is converted in terms of 10 mm in width.

Further, due to the large adhesion between the support for lithographic printing plate and the non-tacky resin layer in the non-image portion, a film strength of the non-image portion is sufficiently maintained against tack of ink and pressure applied at printing and thus, excellent printing durability is obtained. Since the image portion is easily removed due to the small adhesion between the toner image and the support and superfluous steps and devices are unnecessary, rapidness and laborsaving of the image formation and downsizing of an apparatus for the method are realizable.

In a preferred embodiment of the present invention, the non-tacky resin layer in the image portion is removable by a dry process. In such a case, the non-tacky resin layer in the image portion is more selectively and simply removed due to cohesive failure of the toner image. For instance, the non-tacky resin layer in the image portion is easily removed by the application of mechanical power including, peel-apart or brushing to form a pattern of the non-tacky resin layer on the support.

According to another preferred embodiment of the present invention, the surface of support for lithographic printing plate used has a reactive group capable of forming a chemical bond with the non-tacky resin layer at the interface thereof. A chemical reaction occurs at least at the interface between the support for lithographic printing plate and the non-tacky resin layer in the non-image portion to form a crosslinked structure and the adhesion between the non-tacky resin layer and the support is more increased and maintained. As a result, it is possible to make a layer difference in the adhesion of the non-tacky resin layer between the image portion and the non-image portion.

Now, the method for preparation of a waterless lithographic printing plate according to the present invention will be described in detail below.

The construction and material used for the electrophotographic light-sensitive element according to the present invention are not particularly limited and any of those conventionally known can be employed.

Suitable examples of electrophotographic light-sensitive element used are described, for example, in Denshishashin Gakkai (ed.), *Denshishashin Gijutsu no Kiso to Oyo*, Corona (1988), Hiroshi Kokado (ed.), *Saikin no Kododen Zairyo to Kankotai no Kaihatsu.Jitsuyoka*, Nippon Kagaku Joho (1985), Takaharu Shibata and Jiro Ishiwatari, *Kobunshi*, Vol. 17, p. 278 (1968), Harumi Miyamoto and Hidehiko Takei, *Imaging*, Vol. 1973, No. 8, Denshishashin Gakkai (ed.), *Denshishashinyo Yukikankotai no Genjo Symposium* (preprint) (1985), R. M. Schaffert, *Electrophotography*, Forcal Press, London (1980), S. W. Ing, M. D. Tabak and W. E. Haas, *Electro-photography Fourth International Conference*, SPSE (1983), isao Shinohara, Hidetoshi Tsuchida and Hideaki Kusakawa (ed.), *Kirokuzairyo to Kankoseijushi*, Gakkai Shuppan Center (1979), and Hiroshi Kokado, *Kagaku to Kogyo*, Vol. 39, No. 3, p. 161 (1986).

A photoconductive layer for the electrophotographic light-sensitive element which can be used includes a single layer made of a photoconductive compound itself and a photoconductive layer comprising a binder resin having dispersed therein a photoconductive compound. The dispersed type photoconductive layer may have a single layer structure or a laminated structure. The photoconductive compounds used in the present invention may be inorganic compounds or organic compounds.

Inorganic photoconductive compounds used in the present invention include those conventionally known, for example, zinc oxide, titanium oxide, zinc sulfide, cadmium sulfide, selenium, selenium-tellurium, amorphous silicon, and lead sulfide. These compounds are used together with a binder resin to form a photoconductive layer, or they are used alone to form a photoconductive layer by vacuum deposition or spattering.

Where an inorganic photoconductive compound, e.g., zinc oxide or titanium oxide, is used, a binder resin is usually used in an amount of from 10 to 100 parts by weight, and preferably from 15 to 40 parts by weight, per 100 parts by weight of the inorganic photoconductive compound.

Organic photoconductive compounds used may be selected from conventionally known compounds. Suitable photoconductive layers containing an organic photoconductive compound include (i) a layer comprising an organic photoconductive compound, a sensitizing dye, and a binder resin, and (ii) a layer comprising a charge generating agent, a charge transporting agent, and a binder resin or a double-layered structure containing a charge generating agent and a charge transporting agent in separate layers.

The photoconductive layer of the electrophotographic light-sensitive element according to the present invention may have any of the above-described structure.

In the latter case, an organic photoconductive compound is employed as the charge transporting agent.

The organic photoconductive compounds which may be used in the present invention include, for example, triazole derivatives, oxadiazole derivatives, imidazole derivatives, polyarylalkane derivatives, pyrazoline derivatives, pyrazolone derivatives, arylamine derivatives, azulenium salt derivatives, amino-substituted chalcone derivatives, N,N-bicarbazyl derivatives, oxazole derivatives, styrylanthracene derivatives, fluorenone derivatives, hydrazone derivatives, benzidine derivatives, stilbene derivatives, polyvinylcarbazole and derivatives thereof, vinyl polymers, such as polyvinylpyrene, polyvinylanthracene, poly-2-vinyl-4-(4'-dimethylaminophenyl)-5-phenyloxazole and poly-3-vinyl-N-ethylcarbazole, polymers, such as polyacenaphthylene, polyindene and an acenaphthylene-styrene copolymer, triphenylmethane polymers, and condensed resins, such as pyrene-formaldehyde resin, bromopyrene-formaldehyde resin and ethylcarbazole-formaldehyde resin.

The organic photoconductive compounds which can be used in the present invention are not limited to the above-described compounds, and any of known organic photoconductive compounds may be employed in the present invention. The organic photoconductive compounds may be used either individually or in combination of two or more thereof.

The charge generating agents which can be used in the photoconductive layer include various conventionally known charge generating agents, either organic or inorganic, such as selenium, selenium-tellurium, cadmium sulfide, zinc oxide, and organic pigments described below. The charge generating agent is appropriately selected to have spectral sensitivity suitable for a wavelength of a light source employed for image exposure.

The organic pigments used include azo pigments (including monoazo, bisazo, and trisazo pigments), metal-free or metallized phthalocyanine pigments, perylene pigments, indigo or thioindigo derivatives, quinacridone pigments, polycyclic quinone pigments, bisbenzimidazole pigments, squarylium salt pigments, and azulenium salt pigments.

These charge generating agents may be used either individually or in combination of two or more thereof.

The charge transporting agents used in the photoconductive layer include those described for the organic photoconductive compounds above. The charge transporting agent is appropriately selected so as to suite the charge generating agent to be employed in combination.

With respect to a mixing ratio of the organic photoconductive compound and a binder resin, particularly the upper limit of the organic photoconductive compound is determined depending on the compatibility between these materials. The organic photoconductive compound, if added in an amount over the upper limit, may undergo undesirable crystallization. The lower the content of the organic photoconductive compound, the lower the electrophotographic sensitivity. Accordingly, it is desirable to use the organic photoconductive compound in an amount as much as possible within such a range that crystallization does not occur. In general, 5 to 120 parts by weight, and preferably from 10 to 100 parts by weight, of the organic photoconductive compound is used per 100 parts by weight of the total binder resin.

Binder resins which can be used in the light-sensitive element according to the present invention include those for conventionally known electrophotographic light-sensitive elements. A weight average molecular weight of the binder resin is preferably from $5\times10^3$ to $1\times10^6$, and more preferably from $2\times10^4$ to $5\times10^5$. A glass transition point of the binder resin is preferably from −40° to 200° C., and more preferably from −10° to 140° C.

Suitable examples of the binder resin used are described, for example, in Koichi Nakamura (ed.), *Kioku Zairyoyo Binder no Jissai Gijutsu*, Ch. 10, C.M.C. (1985), Tsuyoshi Endo, *Netsukokasei Kobunshi no Seimitsuka*, C.M.C. (1986), Yuji Harasaki, *Saishin Binder Gijutsu Binran*, Ch. II-1, Sogo.Gijutsu Center (1985), Takayuki Otsu, *Acryl Jushi no Gosei-Sekkei to Shinyoto Kaihatsu*, Chubu Kei-ei Kaihatsu Center Shuppanbu (1985), Eizo Omori, *Kinosei Acryl-Kei Jushi*, Techno System (1985), D. Tatt and S. C. Heidecker, *Tappi*, Vol. 49, No. 10, p. 439 (1966), E. S. Baltazzi and R. G. Blanchlotte, et al., *Photo. Sci. Eng.*, Vol. 16, No. 5, p. 354 (1972), and Nguyen Chank Keh, Isamu Shimizu and Eiichi Inoue, *Denshi Shashin Gakkaishi*, Vol. 18, No. 2, p. 22 (1980), in addition to the literature references mentioned with respect to the electrophotographic light-sensitive element above.

Specific examples of binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring which does not contain a nitrogen atom (the heterocyclic ring including, for example, furan, tetrahydrofuran, thiophene, dioxane, dioxofuran, lactone, benzofuran, benzothiophene and 1,3-dioxetane rings), and epoxy resins.

Further, the electrostatic characteristics of photoconductive layer are improved by using as the binder resin a resin having a relatively low molecular weight (e.g., a weight average molecular weight of from $10^3$ to $10^4$) and containing an acidic group such as a carboxy group, a sulfo group or a phosphono group. Suitable examples of such a resin are described, for example, in JP-A-64-70761, JP-A-2-67563, JP-A-3-181948 and JP-A-3-249659.

Moreover, in order to maintain a relatively stable performance even when ambient conditions are widely fluctuated, a specific medium to high molecular weight resin is employed as the binder resin. For instance, JP-A-3-29954, JP-A-3-77954, JP-A-3-92861 and JP-A-3-53257 disclose a resin of graft type copolymer having an acidic group bonded at the terminal of the graft portion or a resin of graft type copolymer containing acidic groups in the graft portion. Also, JP-A-3-206464 and JP-A-3-223762 discloses a resin of graft type copolymer having a graft portion formed from an AB block copolymer comprising an A block containing acidic groups and a B block containing no acidic group.

In a case of using these resins, the photoconductive substance is uniformly dispersed to form a photoconductive layer having good smoothness. Further, excellent electrostatic characteristics can be maintained even when ambient conditions are fluctuated or when a scanning exposure system using a semiconductor laser beam is utilized for the image exposure.

Depending on the kind of a light source for exposure, for example, visible light or semiconductor laser beam, various dyes may be used as spectral sensitizers. The sensitizing dyes used include carbonium dyes, diphenylmethane dyes, triphenylmethane dyes, xanthene dyes, phthalein dyes, polymethine dyes (including oxonol dyes, merocyanine dyes, cyanine dyes, rhodacyanine dyes, and styryl dyes), and phthalocyanine dyes (including metallized dyes), as described, for example, in *Denshishashin*, Vol. 12, p. 9 (1973), *Yuki Gosei Kagaku*, Vol. 24, No. 11, p. 1010 (1966), Harumi Miyamoto and Hidehiko Takei, *Imaging*, Vol. 1973, No. 8, p. 12, C. J. Young et al., *RCA Review*, Vol. 15, p. 469 (1954), Kohei Kiyota et al., *Denkitsushin Gakkai Ronbunshi*, Vol. J 63-C, No. 2, p. 97 (1980), Yuji Harasaki et al., *Kogyo Kagaku Zasshi*, Vol. 66, p. 78 and 188 (1963), Tadaaki Tani, *Nihon Shashin Gakkaishi*, Vol. 35, p. 208 (1972), *Research Disclosure*, No. 216, pp. 117–118 (1982), and F. M. Hamer, *The Cyanine Dyes and Related Compounds*, in addition to the literature references mentioned with respect to the electrophotographic light-sensitive element above.

If desired, the electrophotographic light-sensitive element may further contain various additives conventionally known for electrophotographic light-sensitive elements. The additives include chemical sensitizers for increasing electrophotographic sensitivity and plasticizers or surface active agents for improving film properties.

Suitable examples of the chemical sensitizers include electron attracting compounds such as a halogen, benzoquinone, chloranil, fluoranil, bromanil, dinitrobenzene, anthraquinone, 2,5-dichlorobenzoquinone, nitro phenol, tetrachlorophthalic anhydride, phthalic anhydride, maleic anhydride, N-hydroxymaleimide, N-hydroxyphthalimide, 2,3-dichloro-5,6-dicyanobenzoquinone, dinitrofluorenone, trinitrofluorenone, tetracyanoethylene, nitrobenzoic acid, and dinitrobenzoic acid; and polyarylalkane compounds, hindered phenol compounds and p-phenylenediamine compounds as described in the literature references cited in Hiroshi Kokado, et al., *Saikin no Kododen Zairyo to Kankotai no Kaihatsu.Jitsuyoka*, Chs. 4 to 6, Nippon Kagaku Joho (1986). In addition, the compounds as described in JP-A-58-65439, JP-A-58-102239, JP-A-58-129439, and JP-A-62-71965 may also be used.

Suitable examples of the plasticizers, which may be added for improving flexibility of a photoconductive layer, include dimethyl phthalate, dibutyl phthalate, dioctyl phthalate, diphenyl phthalate, triphenyl phosphate, diisobutyl adipate, dimethyl sebacate, dibutyl sebacate, butyl laurate, methyl phthalyl glycolate, and dimethyl glycol phthalate. The plasticizer can be added in an amount that does not impair electrostatic characteristics of the photoconductive layer.

The amount of the additive to be added is not particularly limited, but ordinarily ranges from 0.001 to 2.0 parts by weight per 100 parts by weight of the photoconductive substance.

The photoconductive layer usually has a thickness of from 1 to 100 μm, and preferably from 10 to 50 μm.

Where a photoconductive layer functions as a charge generating layer of a laminated type light-sensitive element composed of a charge generating layer and a charge transporting layer, the charge generating layer has a thickness of from 0.01 to 5 μm, and preferably from 0.05 to 2 μm.

The photoconductive layer of the present invention can be provided on a conventionally known support. In general, a support for an electrophotographic light-sensitive layer is preferably electrically conductive. The electrically conductive support which can be used includes a substrate (e.g., a metal plate, paper, or a plastic sheet) having been rendered conductive by impregnation with a low-resistant substance, a substrate whose back side (opposite to the light-sensitive layer side) is rendered conductive and further having coated thereon at least one layer for, for example, curling prevention, the above-described substrate having formed on the surface thereof a water-resistant adhesive layer, the above-described substrate having on the surface thereof at least one precoat layer, and a paper substrate laminated with a plastic film on which aluminum, etc. has been vacuum deposited.

Specific examples of the conductive substrate and materials for rendering non-conductive substrates electrically conductive are described, for example, in Yukio Sakamoto, *Denshishashin*, Vol. 14, No. 1, pp. 2–11 (1975), Hiroyuki Moriga, *Nyumon Tokushushi no Kagaku*, Kobunshi Kankokai (1975), and M. F. Hoover, *J. Macromol. Sci. Chem.*, Vol. A-4, No. 6, pp. 1327–1417 (1970).

The method of the present invention includes a step of transferring a non-fixing toner image formed on a surface of an electrophotographic light-sensitive element using a liquid developer from the electrophotographic light-sensitive element as described above. In case of employing a method for transferring a toner image by being brought the toner image on the electrophotographic light-sensitive element into contact with a receiving material which is a support for lithographic printing plate in Step (b-1) or an intermediate transfer medium in Step (b-2), it is desirable that the surface of electrophotographic light-sensitive element has releasability.

More specifically, an electrophotographic light-sensitive element wherein adhesion of the surface thereof is not more than 200 gram.force (g.f) is preferably employed.

Measurement of the adhesion is conducted according to JIS Z 0237-1980 8.3.1. 180 *Degrees Peeling Method* with the following modifications:

(i) As a test plate, an electrophotographic light-sensitive element on which a toner image is to be formed is used.

(ii) As a test piece, a pressure resistive adhesive tape of 6 mm in width prepared according to JIS C2338-1984 is used.

(iii) A peeling rate is 120 mm/min using a constant rate of traverse type tensile testing machine.

Specifically, the test piece is laid its adhesive face downward on the test plate and a roller is reciprocate one stroke at a rate of approximately 300 mm/min upon the test piece for pressure sticking. Within 20 to 40 minutes after the sticking with pressure, a part of the stuck portion is peeled approximately 25 mm in length and then peeled continuously at the rate of 120 mm/min using the constant rate of traverse type tensile testing machine. The strength is read at an interval of approximately 20 mm in length of peeling, and eventually read 4 times. The test is conducted on three test pieces. The mean value is determined from 12 measured values for three test pieces and the resulting mean value is converted in terms of 10 mm in width.

The adhesion of the surface of electrophotographic light-sensitive element is more preferably not more than 100 g.f, and particularly preferably not more than 80 g.f.

By using such an electrophotographic light-sensitive element having the controlled adhesive strength, a toner image formed on the electrophotographic light-sensitive element is easily released therefrom and transferred together onto a receiving material.

It is also desired that the surface of electrophotographic light-sensitive element have good smoothness. Specifically, the arithmetic mean roughness (Ra) of the surface is preferably not more than 2.0 μm, more preferably not more than 1.5 μm. The arithmetic mean roughness (Ra) is defined in JIS B 0601 and the value is determined using a contact profile mater as described in JIS B 0651 (cutoff value ($\lambda c$): 0.16 mm, pricing length (ln): 2.5 mm). By using an electrophotographic light-sensitive element having such a surface smoothness, the releasability of toner image at the time of transfer to a receiving material is further increased and as a result the transferability is improved. This is particularly effective on transfer of highly accurate image.

While an electrophotographic light-sensitive element which has already the surface exhibiting the desired releasability can be employed in the present invention, it is also possible to cause a compound (S) containing at least a fluorine atom and/or a silicon atom to adsorb or adhere onto the surface of electrophotographic light-sensitive element for imparting the releasability thereto before the formation of toner image. Thus, conventional electrophotographic light-sensitive elements can be utilized without taking releasability of the surface thereof into consideration.

Further, when releasability of the surface of electrophotographic light-sensitive element tends to decrease during repeated use of the light-sensitive element having the surface releasability according to the present invention, the method for adsorbing or adhering a compound (S) can be applied. By the method, the releasability of light-sensitive element is easily maintained.

The impartation of releasability onto the surface of electrophotographic light-sensitive element is preferably carried out in an apparatus for conducting an electrophotographic process. For such a purpose, a means for applying the compound (S) to the surface of electrophotographic light-sensitive element is further provided in an electrophotographic apparatus.

In order to obtain an electrophotographic light-sensitive element having a surface of the releasability, there are a method of selecting an electrophotographic light-sensitive element previously having such a surface of the releasability, and a method of imparting the releasability to a surface of electrophotographic light-sensitive element conventionally employed by causing the compound (S) for imparting releasability to adsorb or adhere onto the surface of electrophotographic light-sensitive element.

Suitable examples of the electrophotographic light-sensitive elements previously having the surface of releasability used in the former method include those employing a photoconductive substance which is obtained by modifying a surface of amorphous silicon to exhibit the releasability.

For the purpose of modifying the surface of electrophotographic light-sensitive element mainly containing amorphous silicon to have the releasability, there is a method of treating a surface of amorphous silicon with a coupling agent containing a fluorine atom and/or a silicon atom (for example, a silane coupling agent or a titanium coupling agent) as described, for example, in JP-A-55-89844, JP-A-4-231318, JP-A-60-170860, JP-A-59-102244 and JP-A-60-17750. Also, a method of adsorbing and fixing the compound (S) according to the present invention, particularly a releasing agent containing a component having a fluorine atom and/or a silicon atom as a substituent in the form of a block (for example, a polyether-, carboxylic acid-, amino group- or carbinol-modified polydialkylsilicone) as described in detail below can be employed.

Further, another example of the electrophotographic light-sensitive elements previously having the surface of releasability is an electrophotographic light-sensitive element containing a polymer having a polymer component containing a fluorine atom and/or a silicon atom in the region near to the surface thereof.

The term "region near to the surface of electrophotographic light-sensitive element" used herein means the uppermost layer of the electrophotographic light-sensitive element and includes an overcoat layer provided on a photoconductive layer and the uppermost photoconductive layer. Specifically, an overcoat layer which contains the above-described polymer to impart the releasability is provided on the electrophotographic light-sensitive element having a photoconductive layer as the uppermost layer, or the above-described polymer is incorporated into the uppermost layer of a photoconductive layer (including a single photoconductive layer and a laminated photo-conductive layer) to modify the surface thereof so as to exhibit the releasability. By using such an electrophotographic light-sensitive element, a toner image can be easily and completely transferred since the surface of electrophotographic light-sensitive element has the good releasability.

In order to impart the releasability to the overcoat layer or the uppermost photoconductive layer, a polymer containing a silicon atom and/or a fluorine atom is used as a binder resin of the layer. It is preferred to use a small amount of a block copolymer containing a polymer segment comprising a silicon atom and/or fluorine atom-containing polymer component described in detail below (hereinafter referred to as a surface-localized type copolymer sometimes) in combination with other binder resins. Further, such polymers containing a silicon atom and/or a fluorine atom are employed in the form of grains.

In the case of providing an overcoat layer, it is preferred to use the above-described surface-localized type block copolymer together with other binder resins of the layer for maintaining sufficient adhesion between the overcoat layer and the photoconductive layer.

The surface-localized type copolymer is ordinarily used in a proportion of from 0.1 to 20 parts by weight per 100 parts by weight of the total composition of the overcoat layer, or in a proportion of from 0.5 to 30 parts by weight per 100 parts by weight of the total composition of the uppermost photoconductive layer.

Specific examples of the overcoat layer include a protective layer which is a surface layer provided on an electrophotographic light-sensitive element for protection known as one means for ensuring durability of the surface of electrophotographic light-sensitive element for a plain paper copier (PPC) using a dry toner against repeated use. For instance, techniques relating to a protective layer using a silicon type block copolymer are described, for example, in JP-A-61-95358, JP-A-55-83049, JP-A-62-87971, JP-A-61-189559, JP-A-62-75461, JP-A-62-139556, JP-A-62-139557, and JP-A-62-208055. Techniques relating to a protective layer using a fluorine type block copolymer are described, for example, in JP-A-61-116362, JP-A-61-117563, JP-A-61-270768, and JP-A-62-14657. Techniques relating to a protecting layer using grains of a resin containing a fluorine-containing polymer component in combination with a binder resin are described in JP-A-63-249152 and JP-A-63-221355.

On the other hand, the method of modifying the surface of the uppermost photoconductive layer so as to exhibit the releasability is effectively applied to a so-called disperse type electrophotographic light-sensitive element which contains at least a photoconductive substance and a binder resin.

Specifically, a layer constituting the uppermost layer of a photoconductive layer is made to contain either one or both of a block copolymer resin comprising a polymer segment containing a fluorine atom and/or silicon atom-containing polymer component as a block and resin grains containing a fluorine atom and/or silicon atom-containing polymer component, whereby the resin material migrates to the surface of the layer and is concentrated and localized there to have the surface imparted with the releasability. The copolymers and resin grains which can be used include those described in European Patent Application No. 534,479A1.

In order to further ensure surface localization, a block copolymer comprising at least one fluorine atom and/or fluorine atom-containing polymer segment and at least one polymer segment containing a photo- and/or heat-curable group-containing component as blocks can be used as a binder resin for the overcoat layer or the photoconductive layer. Examples of such polymer segments containing a photo- and/or heat-curable group-containing component are described in European Patent Application No. 534,479A1. Alternatively, a photo- and/or heat-curable resin may be used in combination with the fluorine atom and/or silicon atom-containing resin in the present invention.

The polymer comprising a polymer component containing a fluorine atom and/or a silicon atom effectively used for modifying the surface of the electrophotographic light-sensitive material according to the present invention include a resin (hereinafter referred to as resin (P) sometimes) and resin grains (hereinafter referred to as resin grains (PL) sometimes).

Where the polymer containing a fluorine atom and/or silicon atom-containing polymer component used in the present invention is a random copolymer, the content of the fluorine atom and/or silicon atom-containing polymer component is preferably at least 60% by weight, and more preferably at least 80% by weight based on the total polymer component.

In a preferred embodiment, the above-described polymer is a block copolymer comprising at least one polymer segment (α) containing at least 50% by weight of a fluorine atom and/or silicon atom-containing polymer component and at least one polymer segment (β) containing 0 to 20% by weight of a fluorine atom and/or silicon atom-containing polymer component, the polymer segments (α) and (β) being bonded in the form of blocks. More preferably, the polymer segment (β) of the block copolymer contains at least one polymer component containing at least one photo- and/or heat-curable functional group-containing polymer component.

It is preferred that the polymer segment (β) does not contain any fluorine atom and/or silicon atom-containing polymer component.

As compared with the random copolymer, the block copolymer comprising the polymer segments (α) and (β) (surface-localized type copolymer) is more effective not only for improving the surface releasability but also for maintaining such a releasability.

More specifically, where a film is formed in the presence of a small amount of the resin or resin grains of block copolymer containing a fluorine atom and/or a silicon atom, the resins (P) or resin grains (PL) easily migrate to the surface portion of the film and are localized in situ by the end of a drying step of the film to thereby modify the film surface so as to exhibit the releasability.

Where the resin (P) is the block copolymer in which the fluorine atom and/or silicon atom-containing polymer segment (α) exists as a block, the other polymer segment (β) containing no, or if any a small proportion of, fluorine atom and/or silicon atom-containing polymer component undertakes sufficient interaction with the film-forming binder resin since it has good compatibility therewith. Thus, during the formation of a toner image on the electrophotographic light-sensitive element, further migration of the resin into the toner image is inhibited or prevented by an anchor effect to form and maintain the definite interface between the toner image and the electrophotographic light-sensitive element.

Further, where the segment (β) of the block copolymer contains a photo- and/or heat-curable group, crosslinking between the polymer molecules takes place during the film formation to thereby ensure retention of the releasability at the interface of the electrophotographic light-sensitive element.

The above-described polymer may be used in the form of resin grains as described above.

Where the resin grains according to the present invention are used in combination with a binder resin, the insolubilized polymer segment (α) undertakes migration of the grains to the surface portion and is localized in situ while the polymer segment (β) soluble to a non-aqueous solvent exerts an interaction with the binder resin (an anchor effect) similarly to the above-described resin. When the resin grains or binder resin contain a photo- and/or heat-curable group, further migration of the grains to the toner image can be avoided.

The moiety having a fluorine atom and/or a silicon atom contained in the resin (P) or resin grains (PL) includes that incorporated into the main chain of the polymer and that contained as a substituent in the side chain of the polymer.

Suitable examples of the resin (P) and resin grains (PL) are described in European Patent Application No. 534, 479A1.

Now, the latter method for obtaining an electrophotographic light-sensitive element having the surface of releasability by applying the compound (S) for imparting the desired releasability to the surface of a conventionally known electrophotographic light-sensitive element before the formation of toner image will be described in detail below.

The compound (S) is a compound containing a fluorine atom and/or a silicon atom. The compound (S) containing a moiety having a fluorine and/or silicon atom is not particularly limited in its structure as far as it can improve releasability of the surface of electrophotographic light-sensitive element, and includes a low molecular weight compound, an oligomer, and a polymer.

When the compound (S) is an oligomer or a polymer, the moiety having a fluorine and/or silicon atom includes that incorporated into the main chain of the oligomer or polymer and that contained as a substituent in the side chain thereof. Of the oligomers and polymers, those containing repeating units containing the moiety having a fluorine and/or silicon atom as a block are preferred since they adsorb on the surface of electrophotographic light-sensitive element to impart good releasability.

The fluorine atom and/or silicon atom-containing moieties include those described with respect to the resin (P) above.

When the compound (S) is a so-called block copolymer, the compound (S) may be any type of copolymer as far as it contains the fluorine atom and/or silicon atom-containing polymer components as a block. The term "to be contained as a block" means that the compound (S) has a polymer segment comprising at least 70% by weight of the fluorine atom and/or silicon atom-containing polymer component based on the weight of the polymer segment. The forms of blocks include an A-B type block, an A-B-A type block, a B-A-B type block, a graft type block, and a starlike type block.

Specific examples of the compound (S) containing a fluorine and/or silicon atom which can be used in the present invention include fluorine and/or silicon-containing organic compounds described, for example, in Tokiyuki Yoshida, et al. (ed.), *Shin-ban Kaimenkasseizai Handbook*, Kogaku Tosho (1987), Takao Karikome, *Saishin Kaimenkasseizai Oyo Gijutsu*, C.M.C. (1990), Kunio Ito (ed.), *Silicone Handbook*, Nikkan Kogyo Shinbunsha (1990), Takao Karikome, *Tokushukino Kaimenkasseizai*, C.M.C. (1986), and A. M. Schwartz, et al., *Surface Active Agents and Detergents*, Vol. II.

Further, the compound (S) according to the present invention can be synthesized by utilizing synthesis methods as described, for example, in Nobuo Ishikawa, *Fussokagobutsu no Gosei to Kino*, C.M.C. (1987), Jiro Hirano et al. (ed.), *Ganfussoyukikagobutsu-Sono Gosei to Oyo*, Gijutsu Joho Kokai (1991), and Mitsuo Ishikawa, *Yukikeiso Senryaku Shiryo*, Chapter 3, Science Forum (1991).

By the application of compound (S) onto the surface of electrophotographic light-sensitive element, the surface is modified to have the desired releasability. The term "application of compound (S) onto the surface of electrophotographic light-sensitive element" means that the compound is supplied on the surface of electrophotographic light-sensitive element to form a state wherein the compound (S) is adsorbed or adhered thereon.

In order to apply the compound (S) to the surface of electrophotographic light-sensitive element, conventionally known various methods can be employed. For example, methods using an air doctor coater, a blade coater, a knife coater, a squeeze coater, a dip coater, a reverse roll coater, a transfer roll coater, a gravure coater, a kiss roll coater, a spray coater, a curtain coater, or a calender coater as described, for example, in Yuji Harasaki, *Coating Kogaku*, Asakura Shoten (1971), Yuji Harasaki, *Coating Hoshiki*, Maki Shoten (1979), and Hiroshi Fukada, *Hot-melt Secchaku no Jissai* Kobunshi Kankokai (1979) can be used.

A method wherein cloth, paper or felt impregnated with the compound (S) is pressed on the surface of electrophotographic light-sensitive element, a method of pressing a curable resin impregnated with the compound (S) on the surface of electrophotographic light-sensitive element, a method wherein an electrophotographic light-sensitive element is wetted with a non-aqueous solvent containing the compound (S) dissolved therein, and then dried to remove the solvent, and a method wherein the compound (S) dispersed in a non-aqueous solvent is migrated and adhered on the surface of electrophotographic light-sensitive element by electrophoresis can also be employed.

Further, the compound (S) can be applied on the surface of electrophotographic light-sensitive element by utilizing a non-aqueous solvent containing the compound (S) according to an ink jet method, followed by drying. The ink jet method can be performed with reference to the descriptions in Shin Ohno (ed.), *Non-impact Printing*, C.M.C. (1986). More specifically, a Sweet process or Hartz process of a continuous jet type, a Winston process of an intermittent jet type, a pulse jet process of an ink on-demand type, a bubble jet process, and a mist process of an ink mist type are illustrated.

Silicone rubber is used as the compound (S). It is preferred that silicone rubber is provided on a metal axis to cover and the resulting silicone rubber roller is directly pressed on the surface of electrophotographic light-sensitive element. In such a case, a nip pressure is ordinarily in a range of from 0.5 to 10 $Kgf/cm^2$ and a time for contact is ordinarily in a range of from 1 second to 30 minutes. Also, the electrophotographic light-sensitive element and/or silicone rubber roller may be heated up to a temperature of 150° C. According to this method, it is believed that a part of low molecular weight components contained in-silicone rubber is moved from the silicone rubber roller onto the surface of electrophotographic light-sensitive element during the press. The silicone rubber may be swollen with silicone oil. Moreover, the silicone rubber may be a form of sponge and the sponge roller may be impregnated with silicone oil or a solution of silicone surface active agent.

The application method of the compound (S) is not particularly limited, and an appropriate method can be selected depending on a state (i.e., liquid, wax or solid) of the compound (S) used. A flowability of the compound (S) can be controller using a heat medium, if desired.

The application of compound (S) is preferably performed by a means which is easily incorporated into an electrophotographic apparatus.

An amount of the compound (S) applied to the surface of electrophotographic light-sensitive element is not particularly limited and is adjusted in a range wherein the electrophotographic characteristics of light-sensitive element do not adversely affected in substance. Ordinarily, a thickness of the coating is sufficiently 1 μm or less. By the formation of weak boundary layer as defined in Bikerman, *The Science of Adhesive Joints*, Academic Press (1961), the releasability-imparting effect of the present invention can be obtained. Specifically, when an adhesive strength of the surface of an electrophotographic light-sensitive element to which the compound (S) has been applied is measured according to the method described above, the resulting adhesive strength is preferably not more than 100 gram.force In accordance with the present invention, the surface of electrophotographic light-sensitive element is provided with the desired releasability by the application of compound (S), and the electrophotographic light-sensitive element can be repeatedly employed as far as the releasability is maintained. Specifically, the application of compound (S) is not always necessarily whenever a series of steps for the preparation of a printing plate according to the present invention is repeated. The application may be suitably performed by an appropriate combination of an electrophotographic light-sensitive element, an ability of compound (S) for imparting the releasability and a means for the application.

Suitable examples of the compound (S) and the application thereof are described in JP-A-7-5727.

According to the method of the present invention, a non-fixing toner image is formed on the electrophotographic light-sensitive element by a conventional electrophotographic process using a liquid developer.

The non-fixing toner image means a toner image having adhesion to a support for lithographic printing plate smaller than adhesion of the non-tacky resin layer to the support for lithographic printing plate. The toner image may be subjected to a fixing treatment as long as the above described condition is maintained. The toner image preferably has the adhesion to the support for lithographic printing plate not more than 20 g.f, more preferably not more than 5 g.f as described above.

The formation of non-fixing toner image can be easily performed using a conventionally known liquid developer by eliminating a fixing process with heat.

Where conduction of a certain amount of heat occurs during the electrophotographic process or the succeeding formation step of non-tacky resin layer, the condition described above can be fulfilled by modifying a material for forming the toner image. Specifically, there are (1) a method of using a resin having a glass transition point of not less than 40° C., preferably not less than 80° C. for forming a resin grain of toner, (2) a method of using a cured resin grain having a crosslinked structure therein as described, for example, in U.S. Pat. No. 5,334,475, JP-A-5-34998 and JP-A-5-150562 as a resin grain of toner, and (3) a method of using a colored grain composed of a pigment and a binder resin wherein a content of the pigment is not less than 50% by weight, preferably not less than 80% by weight. A grain of pigment only may be employed.

In order to form the toner image by an electrophotographic process according to the present invention, any method conventionally known can be employed, as long as the above described condition is fulfilled.

The developer which can be used in the present invention includes conventionally known liquid developers for electrostatic photography. For example, specific examples of the liquid developer are described in *Denshishashin Gijutsu no Kiso to Oyo*, supra, pp. 497–505, Koichi Nakamura (ed.), *Toner Zairyo no Kaihatsu. Jitsuyoka*, Chs. 3 and 4, Nippon Kagaku Joho (1985), Gen Machida, *Kirokuyo Zairyo to Kankosei Jushi*, pp. 107–127 (1983), Denshishasin Gakkai (ed.), *imaging*, Nos. 2–5, "Denshishashin no Genzo.Teichaku.Taiden.Tensha", Gakkai Shuppan Center, Denshishashin Gakkai (ed.), *Imaging*, No. 1, "Densishashin no Genzo", pp. 34–42, Denshishashin Gakkai (1977), Soft Giken Shuppanbu (ed.), *Densishashin Process Gijutsu*, pp. 397–408, Keiei Kaihastu Center (1989), and Yuji Harasaki, *Densishasin*, Vol. 16, No. 2, p. 44 (1977).

The typical liquid developer is basically composed of an electrically insulating organic solvent, for example, an isoparaffinic aliphatic hydrocarbon (e.g., Isopar H or Isopar G (manufactured by Esso Chemical Co.), Shellsol 70 or Shellsol 71 (manufactured by Shell Oil Co.) or IP-Solvent 1620 (manufactured by Idemitsu Petro-Chemical Co., Ltd.)) as a dispersion medium, having dispersed therein a colorant (e.g., an organic or inorganic pigment or dye) and a resin for imparting dispersion stability and chargeability to the developer. If desired, the liquid developer can contain various additives for enhancing charging characteristics or improving image characteristics.

The colorant is appropriately selected from known dyes and pigments, for example, benzidine type, azo type including metallized type, azomethine type, xanthene type, anthraquinone type, triphenylmethane type, phthalocyanine type (including metallized type), titanium white, zinc white, nigrosine, aniline black, and carbon black.

The resin includes one insoluble in the insulating organic solvent, one soluble in the insulating organic solvent which is used for stabilizing dispersion of colorant and/or insoluble resin and one having both an insoluble resin component and a soluble resin component. Suitable resin is not particularly limited and appropriately selected from conventionally known resins, for examples, those described for the binder resin of electrophotographic light-sensitive element.

An average diameter of the colored grain or resin grain dispersed in the insulating organic solvent is preferably from 0.05 to 5 μm, more preferably from 0.1 to 3 μm.

In order to migrate dispensed grains in the insulating organic solvent upon electrophoresis, the grains must be electroscopic grains of positive charge or negative charge. For the purpose of imparting or controlling the electroscopic property of dispersed disperse grains, other additives, for example, alkylsulfosuccinic acid metal salts, naphthenic acid metal salts, higher fatty acid metal salts, alkylbenzenesulfonic acid metal salts, alkylphosphoric acid metal salts, lecithin, polyvinylpyrrolidone, copolymers containing a maleic acid monoamido component, coumaroneindene resins, petronate metal salts, and abietic acid-modified meleic acid resins may be added.

Further, compounds as described, for example, in British Patents 893,429 and 934,038, U.S. Pat. Nos. 1,122,397, 3,900,412 and 4,606,989, JP-A-60-179751, JP-A-60-185963, JP-A-2-13965 and JP-A-60-61765 are also employed.

Moreover, in order to improve transferability of the toner image formed with a liquid developer from the electrophotographic light-sensitive element, it is possible to use a spacer grain having an average diameter of from 5 to 20 μm as described, for example, in JP-A-49-34328, JP-A-59-100458, JP-A-60-95550, JP-A-60-239759 and JP-A-61-39057.

Furthermore, if desired, other additives may be added to the liquid developer in order to maintain dispersion stability and charging stability of grains and to improve transferability of grains. Suitable examples of such additives include rosin, petroleum resins, higher alcohols, polyethers, polyethylene glycols, polypropylene glycols, silicone oils, paraffin wax, triazine derivatives, fluororesins and acrylate resins containing organic base as described in JP-A-59-95543 and JP-A-59-160152.

The total amount of these additives is restricted by the electric resistance of the liquid developer. Specifically, if the electric resistance of the liquid developer in a state of excluding the grains therefrom becomes lower than $10^8$ Ω.cm, a sufficient amount of the grains deposited is reluctant to obtain and, hence, it is necessary to control the amounts of these additives in the range of not lowering the electric resistance than $10^8$ Ω.cm.

With respect to the content of each of the main components of the liquid developer, toner grains comprising a resin (and, if desired, a colorant) are preferably present in an amount of from 0.5 to 50 parts by weight per 1000 parts by weight of a carrier liquid. If the toner content is less than 0.5 part by weight, the image density may be insufficient, and if it exceeds 50 parts by weight, the occurrence of fog in the non-image areas may be tended to.

If desired, the above-described resin for dispersion stabilization which is soluble in the carrier liquid is added in an amount of from about 0.5 to about 100 parts by weight per 1000 parts by weight of the carrier liquid. The above-described charge control agent can be preferably added in an amount of from 0.001 to 1.0 part by weight per 1000 parts by weight of the carrier liquid. Other additives may be added to the liquid developer, if desired. The upper limit of the total amount of other additives is determined, depending on electrical resistance of the liquid developer. Specifically, the total amount of additive is preferably controlled so that the liquid developer exclusive of toner particles has an electrical resistivity of not less than $10^9$ Ωcm. If the resistivity is less than $10^9$ Ωcm, a continuous gradation image of good quality may hardly be obtained.

The liquid developer can be prepared, for example, by mechanically dispersing a colorant and a resin in a dispersing machine, e.g., a sand mill, a ball mill, a jet mill, or an attritor, to produce colored grains, as described, for example, in JP-B-35-5511, JP-B-35-13424, JP-B-50-40017, JP-B-49-98634, JP-B-58-129438, and JP-A-61-180248.

The liquid developer can also be obtained by a method comprising preparing dispersed resin grains utilizing a conventionally known non-aqueous dispersion polymerization method and mixing them with colored grains prepared separately by wet dispersion of colorant with a dispersant. The dispersed resin grains by nonaqueous dispersion polymerization method are described, for example, in U.S. Pat. No. 3,990,980, JP-B-4-31109 and JP-A-6-40229.

It is also known to color the dispersed resin grains. In such a case, the dispersed grains prepared can be colored by dyeing with an appropriate dye as described, for example, in JP-A-57-48738, or by chemical bonding of the dispersed grains with a dye as described, for example, in JP-A-53-54029. It is also effective to polymerize a monomer already containing a dye at the polymerization granulation to obtain a dye-containing copolymer as described, for example, in JP-B-44-22955.

The thickness of toner image is 0.5 μm or more, and preferably in a range of from 2 to 3 μm. In such a range of thickness, the toner image is easily removed in the succeeding removing step of toner image portion. This is also advantageous to prevent from using an unnecessarily large amount of the toner.

The toner image formed on the electrophotographic light-sensitive element in the state of non-fixing is then transferred directly or via an intermediate transfer medium to a support for lithographic printing plate according to the present invention.

For the transfer of toner image, any conventionally known methods including, for example, a method of transfer by being brought the toner image on electrophotographic light-sensitive element into contact with a receiving material, i.e., an intermediate transfer medium or a support for lithographic printing plate and an electrostatic transfer method by applying an electric field between the toner image and a receiving material can be employed.

An intermediate transfer medium (primary receptor) employed in the transfer step includes, for example, primary receptor of drum type and endless belt type which are repeatedly usable. A material of the primary receptor is appropriately selected taking the transfer method employed into consideration. In the primary receptor of drum type or endless belt type, an elastic material layer or a stratified structure of an elastic material layer and a reinforcing layer is preferably provided on the surface thereof stationarily or removably so as to be replaced.

A primary receptor used in the contact transfer method has a function of receiving the toner image from the electrophotographic light-sensitive element and then releasing and transferring the toner image to a support for lithographic printing plate. It is important therefore that releasability of the surface of primary receptor is less than releasability of the surface of electrophotographic light-sensitive element but is sufficient for peeling and transferring onto the support for lithographic printing plate. Specifically, the surface of primary receptor has the adhesion larger, preferably 10 g.f larger, more preferably 30 g.f larger, than the adhesion of the surface of electrophotographic light-sensitive element. On the other hand, the adhesion of the surface of primary receptor is preferably from 20 to 200 g.f, more preferably from 30 to 180 g.f.

The adhesion of the surface of primary receptor can be easily adjusted by applying the method as described with respect to the releasability of the surface of electrophotographic light-sensitive element hereinbefore, including the application of the compound (S). The surface of primary receptor has preferably an average roughness of 0.01 mm or below.

Any of conventionally known natural resins and synthetic reins can be used as the elastic material. These resins may be used either individually or as a combination of two or more thereof in a single or plural layer. Specifically, various resins described, for example, in A. D. Roberts, *Natural Rubber Science and Technology*, Oxford Science Publications (1988), W. Hofmann, *Rubber Technology Handbook*, Hanser Publisher (1989) and *Plastic Zairyo Koza*, Vols. 1 to 18, Nikkan Kogyo Shinbunsha can be employed.

Specific examples of the elastic material include styrene-butadiene rubber, butadiene rubber, acrylonitrile-butadiene rubber, cyclized rubber, chloroprene rubber, ethylene-propylene rubber, butyl rubber, chloro-sulfonated polyethylene rubber, silicone rubber, fluoro-rubber, polysulfide rubber, natural rubber, isoprene rubber and urethane rubber. The desired elastic material can be appropriately selected taking releasability, durability, or electroconductivity into consideration. The thickness of elastic material layer is preferably from 0.01 to 10 mm.

Examples of materials used in the reinforcing layer for the elastic material layer include cloth, glass fiber, resin-impregnated specialty paper, aluminum and stainless steel. A spongy rubber layer may be provided between the surface elastic material layer and the reinforcing layer.

Conventionally known materials can be used as materials for the primary receptor of endless belt type. For example, those described in U.S. Pat. No. 3,893,761, 4,684,238 and 4,690,539 are employed. Further, a layer serving as a heating medium may be provided in the belt as described in JP-W-4-503265 (the term "JP-W" as used herein means an "unexamined published international patent application").

With respect to the primary receptor, further reference can be made to JP-W-5-503166, JP-A-2-264280, JP-A-3-243973, JP-A-4-9085, JP-A-5-341661 and JP-A-6-242658.

Suitable procedures of the transfer step are described, for example, in JP-A-2-264280, JP-A-3-168772, JP-A-4-9087, JP-A-3-111719, JP-A-4-50968 and JP-A-56-5568.

It is preferred in the present invention that the non-fixing toner image formed an electrophotographic light-sensitive element is transferred onto a support for lithographic printing plate in the state of non-fixing and after providing thereon a non-tacky resin layer it is removed due to cohesive failure by the application of power from outside.

Now, the non-tacky resin layer provided on a support for lithographic printing plate having a toner image will be described in detail below.

The non-tacky resin layer which can be used in the present invention is a resin layer having adhesion to a surface of support for lithographic printing plate larger than adhesion between the surface of support for lithographic printing plate and a toner image formed thereon, forming an ink repellant surface in order to prevent ink from sticking to the surface at the time of printing after the preparation of a waterless lithographic printing plate and having a good anti-abrasion property. The adhesion of non-tacky resin layer to the surface of support for lithographic printing plate is preferably not less than 200 g.f as described above.

In order to provide the difference in adhesion between the non-image portion and the image portion as described above, the following means are illustrated, but the present invention is not to be limited thereto.

I. Making the non-tacky resin layer of a specific composition.
   i) Incorporating a specific component into the non-tacky resin layer.
   ii) Incorporating a resin for adhesion into the non-tacky resin layer in addition to the non-tacky resin.
   iii) Forming the non-tacky resin layer having a stratified structure composed of an adhesive layer and an ink repellant layer to divide the functions of non-tacky resin layer.

II. Penetrating a coating solution for the non-tacky resin layer into a surface portion of the support for lithographic printing plate having fine roughness to make an anchor effect.

III. Providing a resin layer having an affinity with the non-tacky resin layer on the surface of support for lithographic printing plate.

IV. Forming a chemical bond between the surface of support for lithographic printing plate and the non-tacky resin layer.

These means may be employed individually or in a combination of two or more thereof. These means will be described in more detail hereinafter.

The surface of non-tacky resin layer preferably has a surface energy of not more than 30 $erg.cm^{-1}$ for ink repellency. To control the surface energy in such a range prevent the sticking of ink and provides clear prints free from stain in the non-image portion. The surface energy of non-tacky resin layer is preferably not more than 28 $erg.cm^{-1}$, more preferably not more than 25 $erg.cm^{-1}$, and particularly preferably in a range of from 25 $erg.cm^{-1}$ to 15 $erg.cm^{-1}$.

One example for controlling the surface energy of non-tacky resin layer in the range described above is to incorporate a non-tacky resin, for example, a silicone resin or a fluorinated resin into the non-tacky resin layer.

A resin containing both a silicon atom and a fluorine atom is employed as the non-tacky resin in the present invention. Among the non-tacky resins, silicone resins are preferably employed in the method of the present invention.

The fluorinated resin includes resins mainly composed of polymer component containing a moiety having a fluorine atom.

The moiety having a fluorine atom contained in the resin includes that incorporated into the main chain of polymer and that contained as a substituent in the side chain of polymer.

The fluorine atom-containing moieties include monovalent or divalent organic residues, for example, $—C_nF_{2n+1}$ (wherein n represents an integer of from 1 to 22), $—CFH_2$, $—(CF_2)_m CF_2H$ (wherein m represents an integer of from 1 to 17), $—CF_2—$ and —CFH—.

The fluorine atom-containing organic residue may be composed of a combination thereof. In such a case, they may be combined either directly or via a linking group. The linking groups include divalent organic residues, for example, divalent aliphatic groups, divalent aromatic groups, and combinations thereof, which may or may not contain a bonding group, e.g., —O—, $$-S-,\ -\overset{d^1}{\overset{|}{N}}-,\ -CO-,\ -SO-,\ -SO_2-,\ -COO-,$$

$$-OCO,\ -CONHCO-,\ -NHCONH-,\ -\overset{d^1}{\overset{|}{CON}}-,\ \text{and}$$

$$-SO_2\overset{d^1}{\overset{|}{N}}-,$$

wherein $d^1$ represents an alkyl group having from 1 to 3 carbon atoms.

The polymer component containing a fluorine atom is preferably present in a range of from 80 to 100 parts by weight per 100 parts by weight of the total polymer component of the resin.

The resin may contain a curable functional group. The content of curable functional group in the resin is preferably from 1 to 20% by weight. The curable functional group used will be described in greater detail with respect to the silicone resin hereinafter.

A weight average molecular weight of the fluorinated resin in preferably from $5\times10^3$ to $1\times10^6$, and more preferably from $2\times10^4$ to $5\times10^5$.

The silicone resin includes resins mainly composed of polymer component containing a moiety having a silicon atom. Specific examples of the silicone resins used in the present invention include polymers mainly composed of an organo siloxane repeating unit represented by the general formula (I) shown below.

$$\left(-\overset{R_1}{\overset{|}{\underset{R_2}{\underset{|}{Si}}}}-O-\right) \quad (I)$$

wherein $R_1$ and $R_2$, which may be the same or different, each represents an aliphatic or aromatic hydrocarbon group or a heterocyclic group.

The hydrocarbon group represented by $R_1$ or $R_2$ includes preferably a straight chain or branched chain alkyl group having from 1 to 18 carbon atoms which may be substituted (e.g., methyl, ethyl, propyl, butyl, pentyl, hexyl, heptyl, octyl, nonyl decyl, dodecyl, tridecyl, tetradecyl, hexadecyl, octadecyl, 2-fluoroethyl, trifluoromethyl, 2-chloroethyl, 2-bromodethyl, 2-cyanoethyl, 2-methoxycarbonylethyl, 2-methoxyethyl, 3-bromopropyl, 2-methoxycarbonylethyl, 2,3-dimethoxypropyl, $—(CH_2)_pC_rF_{2r+1}$ (wherein p represents an integer of 1 or 2; and r represents an integer of from 1 to 12), or $—(CH_2)_p—(CF_2)_s—R'$ (wherein p represents an integer of 1 or 2; s represents an integer of from 1 to 12 and R' represents $—CFHCF_3$ or $—CFHCF_2H$)), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, 4-methyl-2-hexenyl, decenyl, dodecenyl, tridecenyl, hexadecenyl, octadecenyl, or linolyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, or dimethoxybenzyl), an alicyclic group having from 5 to 8 carbon atoms which may be substituted (e.g., cyclopentyl, cyclohexyl, 2-cyclohexylethyl, 2-cyclopentylethyl, polyfluorohexyl, methylcyclohexyl, or methoxycyclohexyl), or an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, fluorophenyl, chlorophenyl, difluorophenyl, bromophenyl, cyanophenyl, acetylphenyl, methoxycarbonylphenyl, ethoxycarbonylphenyl, butoxycarbonylphenyl, acetamidophenyl, propionamidophenyl, or trifluoromethylphenyl).

The heterocyclic group represented by $R_1$ or $R_2$ includes preferably a 5-membered or 6-membered heterocyclic ring containing at least one hetero atom selected from nitrogen atom, an oxygen atom and a sulfur atom which may be substituted and may form a condensed ring. Suitable examples of heterocyclic ring include pyrane, furan, thiophene, morpholine, pyrrole, thiazole, oxazole, pyridine, piperidine, pyrrolidone, benzothiazole, benzoxazole, quinoline, or tetrahydrofuran.

It is preferred that both $R_1$ and $R_2$ are methyl groups.

Of the silicone resins, those having a dimethylsiloxane unit, i.e., $R_1$ and $R_2$ each represents a methyl group in the general formula (I), not less than 60% by weight based on the total organo siloxane unit are preferred. The content of dimethylsiloxane unit in the resin is more preferably not less than 75% by weight based on the total organic siloxane unit. By using such a silicone resin, the non-tacky resin layer exhibits excellent ink repellency and thus the occurrence of background stain is prevented.

As the specific component for increasing the adhesion between the non-tacky resin layer and the surface of support for lithographic printing plate in the non-image portion, a group represented by the general formula (I) wherein $R_1$ and $R_2$ each represents a substituted alkyl group (e.g. an alkyl group substituted with a halogen atom or a cyano group), or a substituted or unsubstituted aralkyl, aromatic or heterocyclic group is employed.

Further, the hydrocarbon group or heterocyclic group represented by $R_1$ or $R_2$ containing a polar group, for example, a carboxy group, a hydroxy group, a mercapto group, a phospho group or an amido group, or a divalent connecting group, for example, a ureido group (—NHCONH—), a thioether group (—S—) or a urethane group (—NHCOO—) is also employed.

The content of an organo siloxane unit having such a substituent is preferably less than 40% by weight, more preferably less than 25% by weight based on the total organo siloxane unit.

The dimethylsiloxane unit preferred as the ink repellant component and the other organo siloxane unit for increasing adhesion are preferably present in the above described range and form any of a random copolymer, a block copolymer and a star copolymer without a particular limitation. Using such a resin in the non-tacky resin layer, it is possible to maintain the good ink repellant surface and increase the adhesion to the surface of support for lithographic printing plate.

A weight average molecular weight of the silicone resin is preferably from $5\times10^3$ to $1\times10^6$, and more preferably from $2\times10^4$ to $5\times10^5$.

It is preferred that the non-tacky resin layer containing the non-tacky resin used in the present invention is cured to form a crosslinked structure therein prior to the step of selective removing both the toner image and the non-tacky resin layer provided thereon. As a result, a mechanical strength of the non-tacky resin layer is increased and the non-image portion is not damaged during the step of removing the toner image portion. Further, its resistance against a mechanical pressure at printing is improved and printing durability is increased.

In order to form a cured non-tacky resin layer on the support for lithographic printing plate bearing the toner image, a method of providing the resin layer containing a previously cured non-tacky resin (method (1)) or a method of providing the resin layer and then curing it (method (2)) can be employed.

Any conventionally known method for curing a resin to form a crosslinked structure can be employed to conduct the above described methods (1) and (2). A silicone resin is used as an example in the following description.

For example, a self-crosslinking method of a silicone resin, a method of curing a silicone resin with a crosslinking agent or curing agent containing a group reactive to the silicone resin, a method of curing a silicone resin using a crosslinking agent or curing agent, or a combination thereof can be employed.

A reaction mode of the crosslinking reaction of resin includes any conventionally known chemical reaction to form a bond. Also, a combination of such a reaction can be used.

Specific examples of the reaction mode include the following reactions i) to iv):

i) Crosslinking with an ion bond formed by a chelate reaction between an acidic group (e.g., a carboxy group, a sulfo group, or a phospho group) contained in the resin and a poly-valent metal ion including a cation of poly-valent metal (e.g., Ca, Mg, Ba, Al, Zn, Fe, Sn, Zr or Ti).

ii) Crosslinking with a chemical bond formed by an addition reaction, a substitution reaction or an elimination reaction between organic reactive groups (for example, a hydroxy group, a thiol group, a halogen atom (e.g., a chlorine atom, a bromine atom or an iodine atom), a carboxy group, an acid anhydride group, an amino group, an isocyanate group, a protected isocyanate group (a blocked isocyanate group), an acid halide group, an epoxy group, an imino group, a formyl group, a diazo group or an azido group).

iii) Self-crosslinking with a self-coupling group (for example, —$CONHCH_2OR_1'$ (wherein $R_1'$ represents a hydrogen atom or an alkyl group),

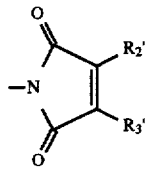

(wherein $R_2'$ and $R_3'$, which may be the same or different, each represents a hydrogen atom or an alkyl group, or $R_2'$ and $R_3'$ may combine each other to form a 5-membered or 6-membered alicyclic ring), a cinnamoyl group or —$Si(R_4')_s(OR_5')_t$ (wherein $R_4'$ represents an alkyl group, an alkenyl group or an aryl group; $R_5'$ represents an alkyl group, s represents an integer of from 0 to 2; and t represents an integer of from 1 to 3, provided that s+t=3)).

iv) Crosslinking by an addition polymerization reaction of a polymerizable double bond group or a polymerizable triple bond group. Suitable examples of the polymerizable double bond group include $CH_2$=C(p)COO—, $C(CH_3)H$=CHCOO—, $CH_2$=$C(CH_2COOH)$COO—, $CH_2$=C(p)CONH—, $CH_2$=C(p)CONHCOO—, $CH_2$=C(p)CONHCONH—, $C(CH_3)H$=CHCONH—, $CH_2$=CHCO—, $CH_2$=$CH(CH_2)_n$OCO—, $CH_2$=CHO—, $CH_2$=$CHC_6H_4$— and $CH_2$=CH—S— wherein p represents a hydrogen atom or a methyl group; and n represents an integer of from 0 to 3. Suitable examples of the polymerizable triple bond group include these groups described above but replacing the double bond with a triple bond.

The reactive group appropriately selected is introduced into the silicon resin through a linking group, if desired. Specifically, (1) either $R_1$, $R_2$ or both per se of the organo siloxane unit represented by the general formula (I) is replaced with the reactive group, or either $R_1$, $R_2$ or both of the organo siloxane unit includes the reactive group, (2) a repeating unit of the silicon resin other than the organo siloxane unit includes the reactive group, or (3) the silicon resin includes the reactive group at the terminal of its polymer chain.

Further, conventionally known specific crosslinking reactions of organo siloxane polymer are effectively employed. These methods are described in details, for example, in Kunio Ito (ed.), *Silicone Handbook*, Nikkan Kogyo Shinbunsha (1990) and Makoto Kumade and Tadashi Wada (supervised), *Saishin Silicone Gijutu-Kaihatsu to Oyo-*, C.M.C. (1986). Specific examples of the reactive group include the followings.

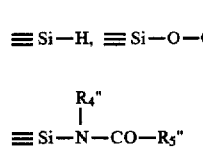

(wherein $R_1''$, $R_2''$, $R_3''$, $R_4''$ or $R_5''$ each represents an alkyl group).

The units containing curable reactive group are present at random in the polymer chain of silicone resin with organo siloxane units represented by the general formula (I) which exhibit ink repellency in case of a random copolymer. The silicone resin also can be a so-called block copolymer wherein a block for ink repellency and a block for curing are bonded. The forms of block include a graft type block, an AB type block (including an ABA type block) and a star type block.

The content of the block for ink repellent in the block copolymer is preferably not less than 30% by weight, and more preferably not less than 50% by weight based on the total polymer component of the silicone resin.

The crosslinking agents or curing agents capable of forming a crosslinked structure in the silicone resin include low molecular weight compounds, oligomers and polymers which are conventionally known as heat-, photo- or moisture-curable compounds. These compounds can be employed individually or in a combination of two or more thereof.

Suitable examples of the crosslinking agent or curing agent used in the present invention include those described, for example, in Shinzo Yamashita and Tosuke Kaneko (ed.), *Kakyozai Handbook*, Taiseisha (1981), Kobunshi Gakkai (ed.), *Kobunshi Data Handbook* (Kisohen), Baifukan (1986), Tsuyoshi Endo, *Netsukokasei Kobunshi no*

*Seimitsuka*, C.M.C. (1986), Yuji Harasaki, *Saishin Binder Gijutsu Binran*, Ch. II-1, Sogo Gijutsu Center (1985), Takayuki Otsu, *Acryl Jushi no Gosei-Sekkei to Shinyoto Kaihatsu*, Chubu Kei-ei Kaihatsu Center Shuppanbu (1985), and *Silicon Handbook*, supra.

Specific examples of suitable crosslinking agents or curing agents include organo silane compounds (e.g., vinyltrimethoxy silane, vinyltriethoxysilane, γ-glycidoxypropyltrimethoxysilane, γ-mercaptopropyltriethoxysilane, γ-aminopropyltriethoxysilane), vinyltrichlorosilane, vinyltris(t-butyl-peroxido)silane, γ-(β-aminoethyl) aminopropyltrimethoxysilane, γ-chloropropyltrimethoxysilane, γ-methacryloxypropyltrimethoxysilane, and silane coupling agents), polyisocyanate compounds (e.g., toluylene diisocyanate, diphenylmethane diisocyanate, triphenylmethane triisocyanate, polymethylenepolyphenyl isocyanate, hexamethylene diisocyanate, isophorone diisocyanate, and polymeric polyisocyanates), blocked polyisocyanate compounds in which isocyanate groups of the above described polyisocyanate compounds are protected (examples of compounds used for the protection of isocyanate group including alcohols, β-diketones, β-ketoesters, and amines), polyol compounds (e.g., 1,4-butanediol, polyoxypropylene glycol, polyoxyethylene glycols, and 1,1,1-trimethylolpropane), polyamine compounds (e.g., ethylenediamine, γ-hydroxypropylated ethylenediamine, phenylenediamine, hexamethylenediamine, N-aminoethylpiperazine, and modified aliphatic polyamines), titanate coupling compounds (e.g., titanium tetrabutoxide, titanium tetrapropoxide, and isopropyltristearoyl titanate), aluminum coupling compounds (e.g., aluminum butylate, aluminum acetylacetate, aluminum oxide octate, and aluminum tris-(acetylacetate)), polyepoxy-containing compounds and epoxy resins (e.g., the compounds as described in Hiroshi Kakiuchi (ed.), *Shin-Epoxy Jushi*, Shokodo (1985) and Kuniyuki Hashimoto (ed.), *Epoxy Jushi*, Nikkan Kogyo Shinbunsha (1969)), melamine resins (e.g., the compounds as described in Ichiro Miwa and Hideo Matsunaga (ed.), *Urea.Melamine Jushi*, Nikkan Kogyo Shinbunsha (1969)), and poly(meth)acrylate compounds (e.g., the compounds as described in Shin Okawara, Takeo Saegusa, and Toshinobu Higashimura (ed.), *Oligomer*, Kodansha (1976), and Eizo Omori, *Kinosei Acryl-kei Jushi*, Techno System (1985)).

Specific examples of the polymerizable functional groups which are contained in the polyfunctional monomer or oligomer (the monomer will sometimes be referred to as a polyfunctional monomer (d)) having two or more polymerizable functional groups include $CH_2{=}CH{-}CH_2{-}$, $CH_2{=}CH{-}CO{-}O{-}$, $CH_2{=}CH{-}$, $CH_2{=}C(CH_3){-}CO{-}O{-}$, $CH(CH_3){=}CH{-}CO{-}O{-}$, $CH_2{=}CH{-}CONH{-}$, $CH_2{=}C(CH_3){-}CONH{-}$, $CH(CH_3){=}CH{-}CONH{-}$, $CH_2{=}CH{-}O{-}CO{-}$, $CH_2{=}C(CH_3){-}O{-}CO{-}$, $CH_2{=}CH{-}CH_2{-}O{-}CO{-}$, $CH_2{=}CH{-}NHCO{-}$, $CH_2{=}CH{-}CH_2{-}NHCO{-}$, $CH_2{=}CH{-}SO_2{-}$, $CH_2{=}CH{-}CO{-}$, $CH_2{=}CH{-}O{-}$, and $CH_2{=}CH{-}S{-}$. The two or more polymerizable functional groups present in the poly-functional monomer or oligomer may be the same or different.

Specific examples of the monomer or oligomer having the same two or more polymerizable functional groups include styrene derivatives (e.g., divinylbenzene and trivinylbenzene); methacrylic, acrylic or crotonic acid esters, vinyl ethers or allyl ethers of polyhydric alcohols (e.g., ethylene glycol, diethylene glycol, triethylene glycol, polyethylene glycol #200, #400 or #600, 1,3-butylene glycol, neopentyl glycol, dipropylene glycol, polypropylene glycol, trimethylolpropane, tri-methylolethane, and pentaerythritol) or polyhydric phenols (e.g., hydroquinone, resorcin, catechol, and derivatives thereof); vinyl esters, allyl esters, vinyl amides, or allyl amides of dibasic acids (e.g., malonic acid, succinic acid, glutaric acid, adipic acid, pimelic acid, maleic acid, phthalic acid, and itaconic acid); and condensation products of polyamines (e.g., ethylenediamine, 1,3-propylenediamine, and 1,4-butylenediamine) and vinyl-containing carboxylic acids (e.g., methacrylic acid, acrylic acid, crotonic acid, and allylacetic acid).

Specific examples of the monomer or oligomer having two or more different polymerizable functional groups include reaction products between vinyl-containing carboxylic acids (e.g., methacrylic acid, acrylic acid, methacryloylacetic acid, acryloylacetic acid, methacryloylpropionic acid, acryloylpropionic acid, itaconyloylacetic acid, itaconyloylpropionic acid, and a carboxylic acid anhydride) and alcohols or amines, vinyl-containing ester derivatives or amide derivatives (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, vinyloxycarbonylmethyloxycarbonylethylene acrylate, N-allylacrylamide, N-allylmethacrylamide, N-allylitaconamide, and methacryloylpropionic acid allylamide) and condensation products between amino alcohols (e.g., aminoethanol, 1-aminopropanol, 1-aminobutanol, 1-aminohexanol, and 2-aminobutanol) and vinyl-containing carboxylic acids.

If desired, a reaction accelerator may be used together with the resin for accelerating the crosslinking reaction in the non-tacky resin layer.

The reaction accelerators which may be used for the crosslinking reaction forming a chemical bond between functional groups include organic acids (e.g., acetic acid, propionic acid, butyric acid, benzenesulfonic acid, and p-toluenesulfonic acid), phenols (e.g., phenol, chlorophenol, nitrophenol, cyanophenol, bromophenol, naphthol, and dichlorophenol), organometallic compounds (e.g., zirconium acetylacetonate, zirconium acetylacetone, cobalt acetylacetonate, and dibutoxytin dilaurate), dithiocarbamic acid compounds (e.g., diethyldithiocarbamic acid salts), thiuram disulfide compounds (e.g., tetramethylthiuram disulfide), and carboxylic acid anhydrides (e.g., phthalic anhydride, maleic anhydride, succinic anhydride, butylsuccinic anhydride, benzophenone-3,3',4,4'-tetracarboxylic acid dianhydride, and trimellitic anhydride).

The reaction accelerators which may be used for the crosslinking reaction involving polymerization include heat-polymerization initiators, such as peroxides and azobis compounds, and photo-polymerization initiators and sensitizers, such as those described, for example, in P. Walker, N. J. Webers, et al., *J. Phot. Sci.*, vol. 18, page 150 (1970) and Katsumi Tokumaru and Shin Okawara (ed.), *Zokanzai*, Kodansha (1987) and including carbonyl compounds, organic sulfur compounds, azine compounds and azo compounds.

In order to accelerate curing or control reaction of the silicone resin, a platinum catalyst, methylvinyltetrasiloxane, or an acetylenealcohol is used.

The condition of curing is appropriately selected depending on each elements to be employed.

Heat-curing is conducted in a conventional manner. For example, the heat treatment is carried out at 60° to 150° C.

for 5 to 120 minutes. The condition of the heat treatment may be made milder by using the above-described reaction accelerator in combination.

Curing of the resin containing a photocurable functional group can be carried out by incorporating a step of irradiation of actinic ray into the method. The actinic rays to be used include visible light, ultraviolet light, far ultraviolet light, electron beam, X-ray, γ-ray, and α-ray, with ultraviolet light being preferred. Actinic rays having a wavelength range of from 310 to 500 nm are more preferred. In general, a low-, high- or ultrahigh-pressure mercury lamp or a halogen lamp is employed as a light source. Usually, the irradiation treatment can be sufficiently performed at a distance of from 5 cm to 50 cm for 10 seconds to 10 minutes.

The content of non-tacky resin in the non-tacky resin layer is preferably from 60% by weight or more, and more preferably from 80% by weight or more based on the total weight of composition of the resin layer.

The non-tacky resin layer used in the present invention can contain other resins in a range which does not adversely affect the ink repellency together with the non-tacky resin in order to increase the adhesion between the non-tacky resin layer and the surface of support for lithographic printing plate.

As the resin for increasing the adhesion, conventionally known various kinds of resins having a softening point of not less than 30° C. may be employed. Suitable examples of these resins include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymer, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, alkyl-modified nylon resins, hydroxy- or carboxy-modified polyester resins, butyral resins, polyvinyl acetal resins, cyclized rubber-methacrylic ester copolymers, cyclized rubber-acrylic ester copolymers, cellulose acetate resins, urethane resins, copolymers containing a heterocyclic ring which does not contain a nitrogen atom (the heterocyclic ring including, for example, furan, tetrahydrofuran, thiophene, dioxane, dioxofuran, lactone, benzofuran, benzothiophene and 1,3-dioxetane rings) and epoxy resins.

The content of resin for increasing the adhesion in the non-tacky resin layer is preferably less than 40% by weight, and more preferably less than 20% by weight based on the total weight of resins employed.

The resin for increasing the adhesion may contain a heat-, photo- or moisture-curable reactive group as describe above.

Of the resins for increasing the adhesion, vinyl alkanoate polymers or copolymers, acrylic resins, methacrylic resins, vinyl chloride resins, cellulose acetate resins, urethane resins and epoxy resins are particularly preferred.

In order to achieve the good ink repellency and the good adhesion in the non-tacky resin layer, the resin for increasing the adhesion is made compatible with the non-tacky resin using the method described, for example, in Gijutujoho Kyokai (ed.), *Kobunshi no Soyoka to Hyokagijutsu*, (1992) and Seiichi Nakahama et al, Kobunshi Gakkai (ed.), *Kokino Polymer Alloy*, Maruzen (1991).

In the layer composed of a mixture of the non-tacky resin and the resin for increasing the adhesion, the characteristic of the non-tacky resin in that it tends to concentrate near the surface of the layer can be utilized. In such a case, it is preferred, as one of the resins for increasing the adhesion, to further employ a copolymer containing a block composed of a polymer component having a fluorine atom and/or a silicon atom same as in the non-tacky resin in a small amount in order to increase the interaction between the resins and to increase the cohesion in the layer.

The non-tacky resin layer used in the present invention may have a stratified structure as described above. For example, a double-layer structure wherein a resin layer having good adhesion (adhesive function layer) is provided adjacent to the support for lithographic printing plate and thereon a layer of the non-tacky resin having good ink repellency is employed.

Maintenance of adhesion between the adhesive function layer and the layer of non-tacky resin having good ink repellency can be performed by adding a copolymer containing a block composed of a polymer component compatible with the resin for increasing the adhesion and a block composed of a polymer component compatible with the non-tacky resin preferably in the adhesive function layer.

As the support for lithographic printing plate onto which the toner image is transferred directly or via an intermediate transfer medium from the electrophotographic light-sensitive element according to the present invention, any support suitable for conventionally known offset printing plate can be employed. For increasing printing durability, a support having good mechanical strength, crumple-resistivity and stretch-resistivity is preferred.

Suitable examples of support include a plastic sheet, paper having been rendered durable to printing, an aluminum plate, a zinc plate, a bimetal plate, e.g., a copper-aluminum plate, a copper-stainless steel plate, or a chromium-copper plate, a trimetal plate, e.g., a chromium-copper-aluminum plate, a chromium-lead-iron plate, or a chromium-copper-stainless steel plate. The support preferably has a thickness of from 0.1 to 3 mm, and particularly from 0.1 to 1 mm.

When the non-tacky resin layer is formed on a surface of support by a coating method, a coating solution for the non-tacky layer penetrates into a surface portion of paper support or support having fine roughness to make good adhesion by an anchor effect. Thus, 200 g.f or more of adhesion between the surface of support (i.e., a side on which a toner image is transferred) and an the non-tacky resin layer formed can be obtained.

Further, adhesion between the support and the non-tacky resin layer can be increased by providing an adhesive layer containing a resin having a good affinity with a resin used in a surface portion of the non-tacky resin layer adjacent thereto. Such a resin having a good affinity includes resins described in the above-mentioned *Kobunshi no Soyoka to Hyokagijutsu* and *Kokino Polymer Alloy*. A suitable resin can be appropriately selected taking a resin used in the non-tacky resin layer into consideration.

In case of employing the non-tacky layer having a stratified structure, a resin having good adhesion to the support is introduced as a resin for the undermost layer.

Moreover, it is preferred that the support for lithographic printing plate is chemically bonded to the non-tacky resin layer. Specifically, the surface portion of support has a reactive group capable of forming a chemical bond with a reactive group present in a resin constituting the non-tacky resin layer by the action of radiation, heat or moisture to form a crosslinked structure between the support and the non-tacky resin layer.

The reactive groups used are same as the curable reactive groups which may be present in the non-tacky resin described above. The reactive group is employed individually or in combination of two or more thereof. The usable group is appropriately selected so as to react with the reactive group in the non-tacky resin to form a chemical bond.

For instance, a surface of support composed of a metal layer is modified to generate a reactive group such as a hydroxy group or a carboxy group by a plasma treatment, electrolytic treatment or chemical treatment.

An adhesive layer containing a resin containing a polymer component having a reactive group capable of reacting with a reactive group present in the non-tacky resin layer is provided on the surface of support.

The content of a polymer component containing the reactive group is at least 1% by weight, preferably not less than 5% by weight based on the total polymer component.

It is more preferred to employ a resin having a polymer component containing a fluorine atom and/or silicon atom in addition to the reactive group in the adhesive layer of support. The fluorine atom and/or silicon atom may be present in a polymer component containing the reactive group or in other polymer component.

Such a type of the reactive group-containing resin is concentrated and localized near the surface portion of the adhesive layer during the formation of the layer due to difference in a surface free energy. As a result, the crosslinking reaction at the interface between the adhesive layer of support and the non-tacky resin layer effectively proceeds.

The polymer components containing a fluorine atom and/or silicon atom may present at random or in the form of block. A block copolymer containing a polymer segment having a fluorine atom and/or silicon atom as a block is preferred. The polymer component containing a fluorine atom and/or a silicon atom and the block copolymer which can be used are described in detail in European Patent Application No. 534,479A1.

Where the polymer containing a fluorine atom and/or silicon atom-containing polymer component used in the present invention is a random copolymer, the content of the fluorine atom and/or silicon atom-containing polymer component is preferably at least 40% by weight, and more preferably at least 60% by weight based on the total polymer component.

In a preferred embodiment, the above-described polymer is a block copolymer comprising at least one polymer segment ($\alpha$) containing at least 50% by weight of a fluorine atom and/or silicon atom-containing polymer component and at least one polymer segment ($\beta$) containing 0 to 20% by weight of a fluorine atom and/or silicon atom-containing polymer component, the polymer segments ($\alpha$) and ($\beta$) being bonded in the form of blocks.

The reactive group-containing resin is preferably employed in such an amount that the content of the reactive group-containing polymer component present therein is from 1 to 30% by weight based on the total component of the adhesive layer of support for lithographic printing plate.

On the whole surface of support bearing the toner image transferred, the non-tacky resin layer is provide. The method for providing the non-tacky resin layer is not particularly limited and any conventionally known method can be employed. Specifically, when the non-tacky resin is a liquid form or soluble in a solvent, methods using an air doctor coater, a blade coater, a knife coater, a squeeze coater, a dip coater, a reverse roll coater, a transfer roll coater, a gravure coater, a kiss roll coater, a spray coater, a curtain coater, or a calender coater as described, for example, in Yuji Harasaki, *Coating Kogaku*, Asakura Shoten (1971), Yuji Harasaki, *Coating Hoshiki*, Maki Shoten (1979), and Hiroshi Fukada, *Hot-melt Secchaku no Jissai* Kobunshi Kankokai (1979) can be used. An ink jet method as described in Shin Ohno (ed.), *Non-impact Printing*, C.M.C. (1986) including, a Sweet process or Hartz process of a continuous jet type, a Winston process of an intermittent jet type, a pulse jet process of an ink on-demand type, a bubble jet process, and a mist process of an ink mist type can also be employed.

Further, a method wherein the non-tacking resin layer provided on a releasable support typically represented by release paper (hereinafter simply referred to as release paper) is transferred onto the support for lithographic printing plate having the toner image thereon is usable.

The release paper having the non-tacky resin layer thereon is simply supplied to a transfer device in the form of a roll or sheet.

The release paper which can be employed in the present invention include those conventionally known as described, for example, in *Nenchaku (Nensecchaku) no Shin Gijutsu to Sono Yoto.Kakushu Oyoseihin no Kaihatsu Siryo*, published by Keiei Kaihatsu Center Shuppan-bu (May 20, 1978), and *All Paper Guide Shi no Shohin Jiten, Jo Kan, Bunka Sangyo Hen*, published by Shigyo Times Sha (Dec. 1, 1983).

Specifically, the release paper comprises a substrate such as nature Clupak paper laminated with a polyethylene resin, high quality paper pre-coated with a solvent-resistant resin, kraft paper, a PET film having an under-coating or glassine having coated thereon a release agent mainly composed of silicone.

A solvent type of silicone is usually employed and a solution thereof having a concentration of from 3 to 7% by weight is coated on the substrate, for example, by a gravure roll, a reverse roll or a wire bar, dried and then subjected to heat treatment at not less than 150° C. to be cured. The coating amount is usually about 1 g/m$^2$.

Release paper for tapes, labels, formation industry use and cast coat industry use each manufactured by a paper making company and put on sale are also generally employed. Specific examples thereof include Separate Shi (manufactured by Oji Paper Co., Ltd.), King Rease (manufactured by Shikoku Seishi K.K.), San Release (manufactured by Sanyo Kokusaku Pulp K.K.) and NK High Release (manufactured by Nippon Kako Seishi K.K.).

In order to form the non-tacky resin layer on release paper, a composition for the non-tacky resin layer is applied to releasing paper in a conventional manner, for example, by bar coating, spin coating or spray coating.

For a purpose of transfer of the non-tacky resin layer on release paper to the support for lithographic printing plate bearing the toner image, a conventional heat transfer method is utilized. Specifically, release paper having the non-tacky resin layer thereon is pressed on the support for lithographic printing plate to heat transfer the non-tacky resin layer.

The conditions for transfer of the non-tacky resin layer from release paper to the support for lithographic printing plate are preferably as follows. A nip pressure of the roller is from 0.1 to 20 kgf/cm$^2$ and more preferably from 0.2 to 10 kgf/cm$^2$. A temperature at the transfer is from 25° to 200° C. and more preferably from 40° to 150° C.

The non-tacky resin layer is preferably cured to withstand a pressure applied at printing as described above. Further, it is preferred that the non-tacky resin layer firmly adheres to the surface of support for lithographic printing plate by a chemical bond.

The formation of cured non-tacky resin layer can be achieved by appropriate application of heat and/or radiation during or after the coating or transfer of the layer. The application of heat and/or radiation is preferably conducted under the condition described above.

After providing the non-tacky resin layer on the support for lithographic printing plate bearing the toner image, the support is subjected to selective removal of the non-tacky resin layer only in the toner image portion. In order to selectively remove the non-tacky resin layer, a wet process or a dry process can be employed.

In the wet process, the non-tacky resin layer on the toner image is swollen with a solvent and removed in the image portion, while applying a mechanical power such as rubbing if desired, as described, for example, in JP-A-49-121602.

The dry process is preferred in view of simplification of the operation. The dry process is not particularly limited and any method including application of power from outside can be utilized in the present invention.

Specific examples of the suitable method include a peel apart method using an adhesive sheet, a brushing method using a brush and a rubbing method using a rubber.

Further, in case of providing the non-tacky resin layer by the transfer method from release paper, the toner image portion is selectively removed at the time of peeling the release paper by appropriately controlling the releasability between the non-tacky resin layer and the release paper. Specifically, the non-tacky resin layer on release paper is pressed to the support for lithographic printing plate and then the release paper is stripped. At that time, the non-tacky resin layer in the non-image portion is transferred and remains on the support and on the other hand, the non-tacky resin layer in the toner image portion is removed together with the release paper (a so-called peel apart method).

The lithographic printing plate thus-obtained according to the method of the present invention can be employed on various offset printing machines without using dampening water in the same manner as conventionally known waterless lithographic printing plate.

In accordance with the present invention, the method for preparation of a waterless lithographic printing plate by an electrophotographic process which is suitable for a scanning exposure system using a laser beam of a low power and which provides a lithographic printing plate excellent in image qualities and printing durability in a simple, rapid and laborsaving manner is provided. The waterless lithographic printing plate obtained is capable of faithfully reproducing a highly accurate image.

The present invention is illustrated in greater detail with reference to the following examples, but the present invention is not to be construed as being limited thereto.

EXAMPLE 1

A mixture of 2 g of X-form metal-free phthalocyanine (manufactured by Dainippon Ink and Chemicals, Inc.), 14.4 g of Binder Resin (B-1) having the structure shown below, 3.6 g of Binder Resin (B-2) having the structure shown below, 0.15 g of Compound (A) having the structure shown below, and 80 g of tetrahydrofuran was put into a 500 ml-volume glass container together with glass beads and dispersed in a paint shaker (manufactured by Toyo Seiki Seisakusho Co.) for 60 minutes. The glass beads were separated by filtration to prepare a dispersion for a light-sensitive layer.

Binder Resin (B-1)

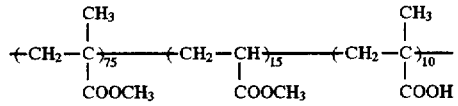

Mw $6 \times 10^4$ (weight ratio)

Binder Resin (B-2)

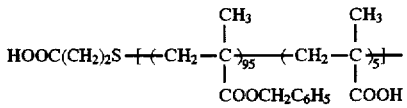

Mw $8 \times 10^3$

Compound (A)

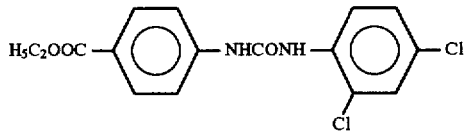

The resulting dispersion was coated on an aluminium plate having a thickness of 0.2 mm, which had been subjected to degrease treatment, by a wire bar, set to touch, and heated in a circulating oven at 110° C. for 20 seconds to form a light-sensitive layer having a thickness of 8 μm.

A toner image was then formed on the electrophotographic light-sensitive element thus-prepared by an electrophotographic process. Specifically, the electrophotographic light-sensitive element was charged to +450 V with a corona charger in a dark place and image-exposed to light using a semiconductor laser having an oscillation wavelength of 788 nm as an exposure device at an irradiation dose on the light-sensitive element of 30 erg/cm$^2$ based on digital image data of an information which had been obtained by reading an original by a color scanner, conducting several corrections relating to color reproduction specific for color separation system and stored in a hard disc.

Liquid Developer (LD-1) having a negative charge was prepared in the following manner.

A mixture of 2 parts by weight of ethylene/methacrylic acid copolymer (Nucrel N-699 manufactured by Du Pont-Mitsui Polychemicals Co., Ltd.), 2 parts by weight of carbon black (#30 manufactured by Mitsubishi Kasei Corp.) and 12 parts by weight of Isopar L (manufactured by Exxon Co., Ltd.) was kneaded in a kneader at 100° C. for 2 hours to prepare a kneading product. The kneading product was cooled and then pulverize in the kneader. One part by weight of the pulverized product and 4 parts by weight of Isopar H were dispersed in a paint shaker for 6 hours. The resulting dispersion was diluted with Isopar G (manufactured by Exxon Co., Ltd.) so that the concentration of solid material was one gram per liter, and basic barium petronate was added thereto in an amount of 0.1 g per one liter as a charge control agent for imparting a negative charge to prepare liquid Developer (LD-1).

The electrophotographic light-sensitive element having an electrostatic latent image was developed with Liquid Developer (LD-1) and then rinsed Isopar G which was a non-polar aliphatic hydrocarbon to remove a fog in the non-image portion.

The electrophotographic light-sensitive element bearing the toner image while maintaining 10 mg of Isopar G per 1 mg of toner was subjected to corona discharge of -6 KV without heat-fixing, superposed on a support used for an electrophotographic lithographic printing plate precursor (ELP-IX manufactured by Fuji Photo Film Co., Ltd.), and corona discharge of electric charge opposite to the toner was applied thereto from the side of the support to transfer the toner image onto the support.

The toner image transferred on the support was observed by an optical microscope of 200 magnifications. It was found that the image was excellent in that cutting or smudge of fine lines or fine letters did not occur, dots of 150 lines per inch was well reproduced and uniformity in high density areas was sufficiently maintained. The adhesion of toner image portion to the support was 10 g.f.

On the support bearing the toner image was provided a non-tacky resin layer composed of silicone rubber. Specifically, a mixed solution of 6 g of silicone rubber of condensation type (KS705F manufacture by Shin-Etsu Silicone Co., Ltd.), 240 mg of CAT-PS-1 (manufactured by Shin-Etsu Silicone Co., Ltd.), 120 ml of CAT-PD (manufactured by Shin-Etsu Silicone Co., Ltd.), 2 g of vinyl acetate/crotonic acid (99/1 ratio by mole) and 34 g of a mixed solvent of heptane and tetrahydrofuran (3:1 ratio by weight) was coated on the whole support bearing the toner image by a wire bar and heated at 80° C. for 2 minutes to conduct drying and curing, thereby forming a non-tacky resin layer having a thickness of 2.12 μm.

Then, the non-tacky resin layer was uniformly rubbed with a PS sponge (manufactured by Fuji Photo Film Co., Ltd.) to remove the non-tacky resin layer only in the toner image portion. As a result, a pattern of the non-tacky resin layer of silicone rubber corresponding to the non-image portion was formed.

The resulting printing plate was subjected to printing using a printing machine (Toko Offset 810L manufactured by Tokyo Koku Keiki Co., Ltd. and a black ink (Dri-O-Color manufactured by Dainippon ink and Chemicals, Inc. without supplying dampening water. More than 3,000 good prints wherein the image was clear without cutting of fine line and fine letter, and background stain was not recognized at all in-the non-image portion.

COMPARATIVE EXAMPLE 1

The support bearing the toner image same as in Example 1 was heated at 110° C. for 3 minutes to fix the toner image. The adhesion of toner image portion to the support was 150 g.f.

On the support bearing the toner image was provided a non-tacky resin layer in the same manner as in Example 1. A thickness of the resulting non-tacky resin layer of silicone rubber was 2.15 μm.

Then, the non-tacky resin layer was rubbed to remove it in the toner image portion under the same condition as in Example 1 to prepare a lithographic printing plate. Using the resulting printing plate, printing was performed in the same manner as in Example 1. Only prints of poor image reproduction were obtained due to insufficient adhesion of ink to the image portion.

As a result of observation of the printing plate using a scanning electron microscope (JSM-T330 manufactured by JEOL Ltd.), it was found that the non-tacky resin layer was not sufficiently removed in the image portion.

The sufficient removal of non-tacky resin layer in the image portion was achieved by conducting rubbing with the sponge under a hard condition. Under such condition, however, many scratches occurred in the non-image portion of non-tacky resin layer which resulted in stains on prints. Consequently, it is difficult to sufficiently remove the non-tacky resin layer in the image portion without damaging the non-image portion of non-tacky resin layer, and the condition is strictly limited, even if it is possible.

It is believed that a reason for the poor removal of non-tacky resin layer in the image portion as described in Comparative Example 1 resides in an insufficiently small difference between adhesion of the support to the non-tacky resin layer in the non-image portion and adhesion of fixed toner image to the support in the image portion. The measurement of adhesion was conducted by the method described above.

On the contrary, in the method of Example 1, the toner image was not fixed and the non-tacky resin layer in the image portion did not substantially adhere to the support. Therefore, the non-tacky resin layer in the image portion was easily removed without suffering any damage on the non-tacky resin layer in the non-image portion.

EXAMPLE 2

A mixture of 2 g of X-form metal-free phthalocyanine (manufactured by Dainippon Ink and Chemicals, Inc.), 14 g of Binder Resin (B-3) having the structure shown below, 4 g of Binder Resin (B-4) having the structure shown below, 0.17 g of Compound (B) having the structure shown below, and 60 g of tetrahydrofuran was put into a 500 ml-volume glass container together with glass beads and dispersed in a paint shaker (manufactured by Toyo Seiki Seisakusho Co.) for 60 minutes. The glass beads were separated by filtration to prepare a dispersion for a light-sensitive layer.

Binder Resin (B-3)

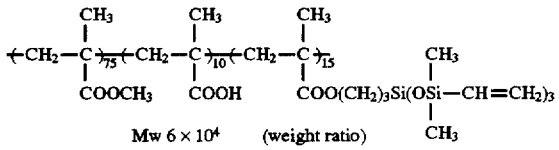

Mw $6 \times 10^4$ (weight ratio)

Binder Resin (B-4)

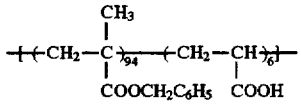

Mw $7 \times 10^3$

Compound (B)

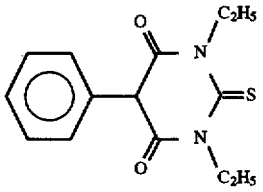

Using the resulting dispersion, a light-sensitive layer having a thickness of 10 μm was formed in the same manner as in Example 1. Then, a surface layer for imparting releasability was provided on the light-sensitive layer.

Formation of Surface Layer for Imparting Releasability

A coating composition comprising 10 g of silicone resin having the structure shown below, 1 g of crosslinking agent having the structure shown below, 0.2 g of crosslinking controller having the structure shown below, 0.1 g of platinum as a catalyst for crosslinking and 100 g of n-hexane was coated by a wire round rod, set to touch, and heated at 120° C. for 10 minutes to form the surface layer having a thickness of 1.5 μm. The adhesion of the surface of the resulting electrophotographic light-sensitive element was not more than 1 g.f.

Silicone Resin

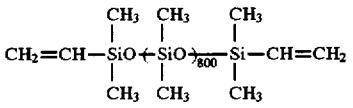

(presumptive structure)

Crosslinking Agent

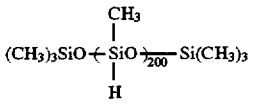

(presumptive structure)

Crosslinking Controller $CH{\equiv}C{-}Si(OCH_3)_3$

An electrostatic latent image was formed on the electrophotographic light-sensitive element having the surface of releasability thus-prepared by an electrophotographic process in the same manner as in Example 1 except for charging it to +550 V.

Liquid Developer (LD-2) having a positive charge was prepared in the following manner.

1) Synthesis of Toner Resin Particles

A mixed solution of 100 g of methyl methacrylate, 20 g of a dispersion polymer having the structure shown below, and 680 g of Isopar H was heated to 65° C. under nitrogen gas stream with stirring. To the solution was added 1.0 g of 2,2'-azobis(isovaleronitrile) (abbreviated as AIVN), followed by reacting for 4 hours. To the reaction mixture was further added 0.5 g of AIVN, and the reaction was continued for 2 hours. To the reaction mixture was further added 0.5 g of AIVN, and the reaction was continued for 2 hours. The temperature was raised up to 90° C., and the mixture was stirred under a reduced pressure of 30 mm Hg for 1 hour to remove any unreacted monomer. After cooling to room temperature, the reaction mixture was filtered through a nylon cloth of 200 mesh to obtain a white dispersion. The reaction ratio of the monomers was 98% by weight, and the resulting dispersion had an average grain diameter of resin grain of 0.25 μm (measured by CAPA-500 manufactured by Horiba, Ltd.) and good monodispersity. A Tg of the resin was 115° C.

Dispersion Polymer

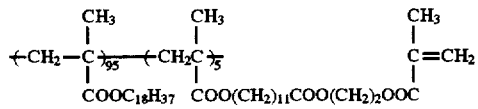

Mw $4\times10^4$ (weight ratio)

2) Preparation of Colored Particles

Ten grams of a tetradecyl methacrylate/methacrylic acid copolymer (95/5 ratio by weight), 10 g of nigrosine, and 30 g of Isopar G were put in a paint shaker (manufactured by Toyo Seiki Seisakusho Co.) together with glass beads and dispersed for 4 hours to prepare a fine dispersion of nigrosine.

3) Preparation of Liquid Developer

A mixture of 45 g of the above-prepared toner resin particle dispersion, 25 g of the above-prepared nigrosine dispersion, 0.6 g of a hexadecene/maleic acid monooctadecylamide (1/1 ratio by mole) copolymer, and 15 g of branched octadecyl alcohol (FOC-1800 manufactured by Nissan Chemical industries, Ltd.) was diluted with 1 l of Isopar G to prepare Liquid Developer (LD-2) for electrophotography.

The electrophotographic light-sensitive element having an electrostatic latent image was subjected to reversal development using Liquid Developer (LD-2) described above while applying a bias voltage of +400 V to an electrode of a developing device to electrodeposite toner particles on the exposed areas, and then rinsed with a bath of Isopar H alone to remove a stain in the non-image portion.

A support of ELP-IX having provided thereon an adhesive layer composed of an acrylic ester type adhesive (Polythick 1001-S manufactured by Sanyo Chemical Industries, Ltd.) having a thickness of 1.5 μm was heated at a surface temperature of 90° C. and brought into contact with the electrophotographic light-sensitive element bearing the toner image described above under a pressure of 4.5 Kgf/$cm^2$, followed by cooling to a room temperature. The support was separated from the electrophotographic light-sensitive element and the toner image was transferred onto the adhesive layer of the support.

The toner image transferred to the support was clear and unevenness, smudge or cutting of the image was not observed. The adhesion of toner image portion to the support was 5 g.f.

On the support was coated silicone rubber of ultraviolet ray-curable type (TFC7700 manufactured by Toshiba Silicone Co., Ltd.) by a wire bar and irradiated with a high pressure mercury lump (UM 102 manufactured by Ushio Inc.) at a distance of 5 cm for 30 seconds. A thickness of the resulting non-tacky resin layer was 2.2 μm.

The non-tacky resin layer was uniformly brushed to remove the non-tacky resin layer only in the image portion, whereby a pattern of the non-tacky resin layer of silicone rubber corresponding to the non-image portion was formed.

The resulting lithographic printing plate was subjected to printing in the same manner as in Example 1. More than 3,000 good prints of clear image without stain in the non-image portion were obtained.

EXAMPLE 3

5 g of 4,4'-bis(diethylamino)-2,2'-dimethyltriphenylmethane as an organic photoconductive substance, 5 g of Binder Resin (B-5) having the structure shown below, 1 g of Binder Resin (B-6) having the structure shown blow, 40 mg of Methine Dye (D-1) having the structure shown below, and 0.2 g of Compound (A) described above as a chemical sensitizer were dissolved in a mixed solvent of 30 ml of methylene chloride and 30 ml of ethylene chloride to prepare a solution for a light-sensitive layer.

Binder Resin (B-5)

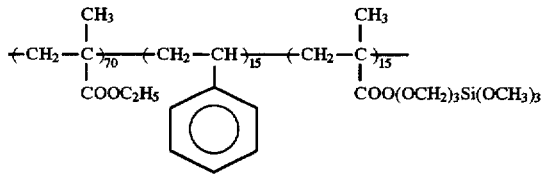

Mw 5 × 10⁴

Binder Resin (B-6)

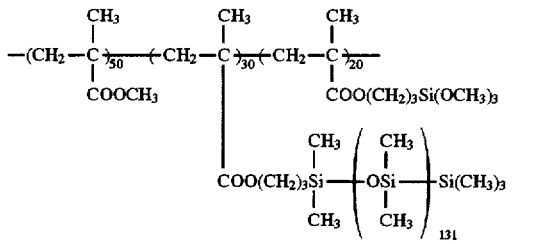

Mw 4 × 10⁴

Methine Dye (D-1)

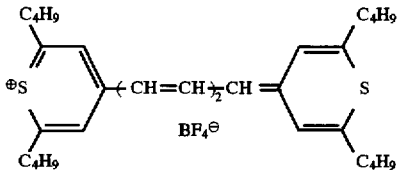

The resulting solution for light-sensitive layer was coated on a conductive transparent substrate composed of a 100 μm thick polyethylene terephthalate film having a deposited layer of indium oxide thereon (surface resistivity: $10^3$ Ω) by a wire round rod and heated at 70° C. for 2 hours for crosslinking to prepare an electrophotographic light-sensitive element having an organic photoconductive layer having a thickness of about 5 μm. The adhesion of the surface of the electrophotographic light-sensitive element was 3 g.f due to the effect of Binder Resin (B-6).

On the electrophotographic light-sensitive element was formed a toner image in the same manner as in Example 1. The toner image was transferred onto a primary receptor provided with a blanket for offset printing (9600-A manufactured by Meiji Rubber & Co., Ltd.) having the adhesion of 80 g.f and a thickness of 1.6 mm under the same condition of Example 1. The toner image was then transferred onto an aluminum plate of 150 μm having provided thereon an adhesive layer composed by Resin (A-1) having the structure shown below having a thickness of 1.5 μm by a pre-charge method while applying an electric voltage of −5 KV to the primary receptor.

Resin (A-1)

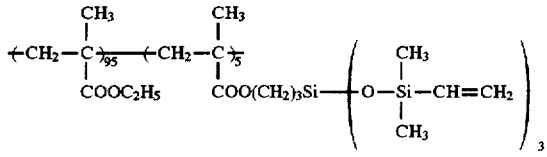

Mw 6 × 10⁴

Then, a mixed solution of 6 g silicone rubber of addition type (KS774 manufactured by Shin-Etsu Silicone Co., Ltd.), 180 mg of CAT-PL-4 (manufactured by Shin-Etsu Silicone Co., Ltd.) and 34 g of heptane was coated on the whole aluminum support bearing the toner image by a wire bar and heated at 90° C. for 2 minutes to conduct drying and crosslinking, thereby forming a non-tacky resin layer having a thickness of 2.1 μm.

The non-tacky resin layer was removed only in the image portion by brushing to prepare a lithographic printing plate. As a result of visual observation of the toner image portion on printing plate using an optical microscope of 200 magnifications, it was found that a highly accurate image such as a fine line of 10 μm in width and a range of from 2 to 98% in dots of 150 lines per inch was clearly formed without cutting.

Using the printing plate, printing was conducted in the same manner as in Example 1. More than 50,000 good prints wherein the highly accurate image was reproduced without substantial degradation and background stain was not recognized at all in the non-image portion were obtained.

It is believed that the formation of chemical bond at the interface between the non-tacky resin layer composed of silicone rubber of addition reaction type and the non-image portion of the support for lithographic printing plate having the adhesive layer containing Resin (A-1) by a chemical reaction remarkably improves adhesion therebetween. As a result, even the fine image portion is easily removed due to the sufficient difference in the adhesion in the image portion and in the non-image portion, and the highly accurate image is well reproduced on the print. Further, printing durability of the printing plate is improved.

EXAMPLE 4

On an aluminum support bearing a toner image prepared in the same manner as in Example 3 was provided a non-tacky resin layer in the following manner.

A mixed solution of 9 g of Silicone Rubber Base Polymer (SB-1) having the structure shown below, 400 mg of Crosslinking Agent (SV-1) having the structure shown below, 40 mg of a catalyst (X92-1114 manufactured by Shin-Etsu Silicone Co., Ltd.) and 60 g of heptane was coated on the whole support bearing the toner image by a wire bar and heated at 90° C. for 2 minutes to conduct drying and crosslinking, thereby forming a non-tacky resin layer having a thickness of 2.21 μm.

Silicon Rubber Base Polymer (SB-1)

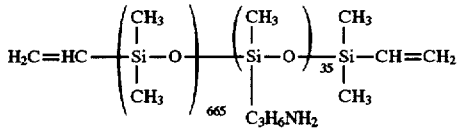

Crosslinking Agent (SV-1)

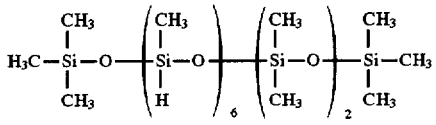

The non-tacky resin layer sufficiently adhered to the adhesive layer on the support in the non-image portion.

The removal of non-tacky resin layer in the image portion to prepare a lithographic printing plate and printing using the resulting plate were conducted in the same manner as in Example 1. More than 50,000 good prints of clear image without stain in the non-image portion were obtained.

EXAMPLE 5

The same procedure as in Example 4 was repeated except for using Silicone Rubber Base Polymer (SB-2) having the structure shown below in place of Silicone Rubber Base Polymer (SB-1).

More than 50,000 good prints similar to those in Example 4 were obtained.

Silicone Rubber Base Polymer (SB-2)

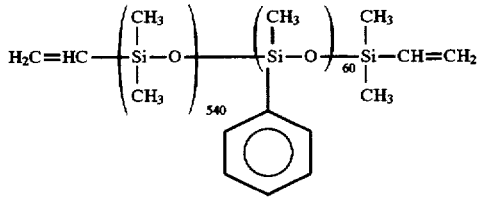

EXAMPLE 6

The same procedure as in Example 4 was repeated except for using Silicone Rubber Base Polymer (SB-3) having the structure shown below in place of Silicone Rubber Base Polymer (SB-1).

More than 50,000 good prints similar to those in Example 4 were obtained.

Silicone Rubber Base Polymer (SB-3)

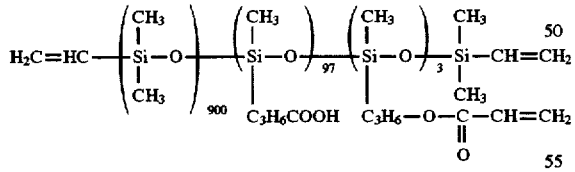

EXAMPLE 7

An amorphous silicon electrophotographic light-sensitive element (manufactured by Kyocera Corp.) was immersed in a solution containing 1 g of Compound (S-1) for imparting releasability shown below dissolved in one liter of Isopar G and dried. By this treatment, the surface of amorphous silicon electrophotographic light-sensitive element was modified so as to exhibit the desired releasability and its adhesion was decreased from 250 g.f to 3 g.f.

Compound (S-1)

Silicone surface active agent (SiLWet FZ-2171 manufactured by Nippon Unicar Co., Ltd.)

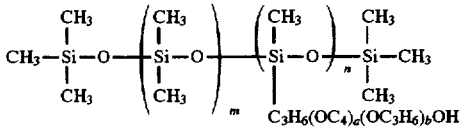

(presumptive structure)

The resulting electrophotographic light-sensitive element was charged to +700 V with a corona discharge in a dark place and exposed to light using a semiconductor laser having an oscillation wavelength of 780 nm on the basis of digital image data of an information which had been obtained by reading an original by a color scanner, conducting several corrections relating to color reproduction specific for color separation system and stored in a hard disc. The potential in the exposed area was +220 V while it was +600 V in the unexposed area.

The exposed electrophotographic light-sensitive element was pre-bathed with Isopar G (manufactured by Esso Standard Oil Co.) by a pre-bathing means installed in a developing unit and then subjected to reversal development by supplying Liquid Developer (LD-3) having the composition described below from the developing unit to the surface of electrophotographic light-sensitive element while applying a bias voltage of +500 V to the developing unit side to thereby electrodeposite toner particles on the unexposed areas. The electrophotographic light-sensitive element was then rinsed in a bath of Isopar G alone to remove a stain in the non-image areas and dried by a suction/exhaust unit.

Liquid Developer (LD-3)

A copolymer of methyl methacrylate and octadecyl methacrylate (95/5 ratio by weight) having a glass transition point of 100° C. as a coating resin and carbon black (#40 manufactured by Mitsubishi Kasei Corporation) were thoroughly mixed in a weight ratio of 1:1 and kneaded by a three-roll mill heated at 150° C. A mixture of 12 g of the resulting kneading product, 4 g of a copolymer of styrene and butadiene (Sorprene 1205 manufactured by Asahi Kasei Kogyo K.K.) and 76 g of Isopar G was dispersed in a Dyno-mill. The toner concentrate obtained was diluted with Isopar G so that the concentration of solid material was 6 g per liter, and $1\times10^{-4}$ mol per liter of sodium dioctylsulfosuccinate was added thereto to prepare Liquid Developer (LD-3).

A mixture of an acrylic ester type adhesive (Boncoat AB-885 manufactured by Dainippon Ink and Chemicals, Inc.) and Resin (A-2) having the structure shown below in a weight ratio of 9:1 was applied on a plate of SUS-430 (manufactured by Kawasaki Steel Corporation) having a thickness of 100 μm and heated at 140° C. for 3 minutes for curing to prepare an adhesive layer having a thickness of 1 μm thereby preparing a support for printing plate. The support was heated at a surface temperature of 90° C. and brought into contact with the electrophotographic light-sensitive element bearing the toner image described above under a pressure of 4.5 Kgf/cm$^2$ to transfer the toner image from the electrophotographic light-sensitive element to the support. The adhesion of toner image portion to the support was 8 g.f, and the toner image was in a non-fixing state.

Resin (A-2)

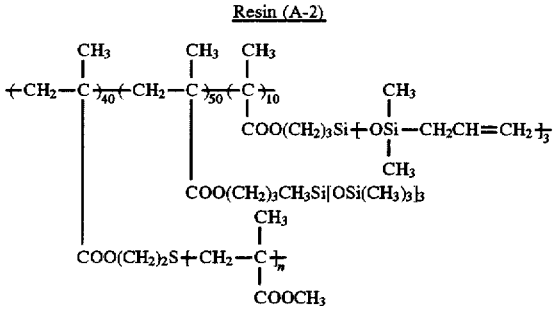

Mx 6 × $10^4$ (Mw of graft portion 1.5 × $10^4$)

A mixed solution of 6 g of silicone rubber of ultraviolet ray-curable type (UV9300 manufactured by Toshiba Silicone Co., LTD.), 60 mg of UV9310C (manufactured by Toshiba Silicone Co., LTD. ) and 34 g of heptane was coated on the whole support bearing the toner image by a coating machine having a head unit and control unit of a small type ink-jet printer (manufactured by EPSON Co., Ltd. ) equipped with an appropriate convey system and ink-feeding system and irradiated with a high-pressure mercury lamp (UM-102 manufactured by Ushio Inc.) at a distance of 3 cm for 7 seconds. A thickness of the resulting non-tacky resin layer was 2.5 μm.

The removal of non-tacky resin layer in the image portion to prepare a lithographic printing plate and printing using the resulting plate were conducted in the same manner as in Example 3. More than 50,000 good prints of clear image without stain in the non-image portion similar to those in Example 3 were obtained.

EXAMPLES 8 TO 11

A waterless lithographic printing plate was prepared in the same manner as in Example 7 except for employing each of Resins (A) shown in Table 1 below in place of Resin (A-2) used in the adhesive layer of support.

In each of waterless lithographic printing plate precursors, a sufficient difference in adhesion between the image portion and the non-image portion was maintained. Each waterless lithographic printing plate provided more than 50,000 good prints of clear image even in highly accurate image portions without background stain in the non-image portion similar to those in Example 7.

TABLE 1

| Example | Resin (A) |
|---|---|
| 8 | (A-3) 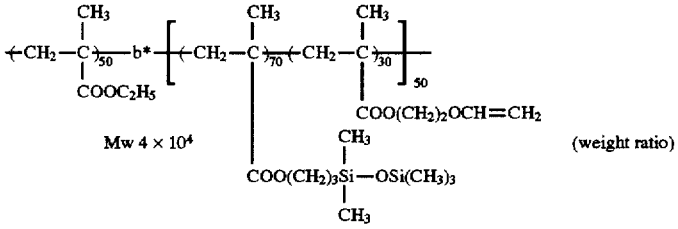 Mw 4 × $10^4$ (weight ratio) |
| 9 | (A-4) 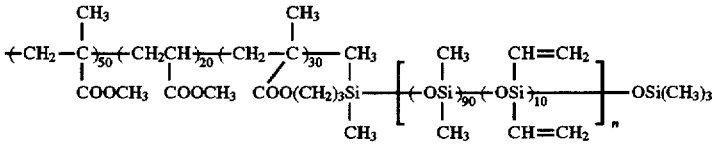 Mw 5 × $10^3$ (Mw of graft portion: 1 × $10^4$) |
| 10 | (A-5) 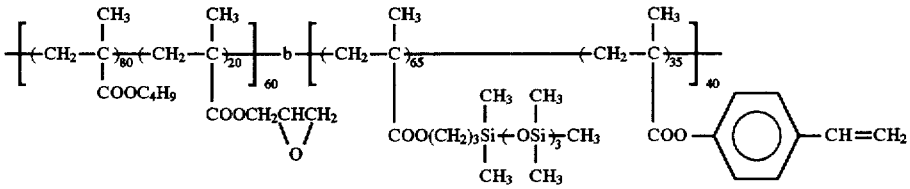 Mw 6 × $10^4$ |
| 11 | (A-6) 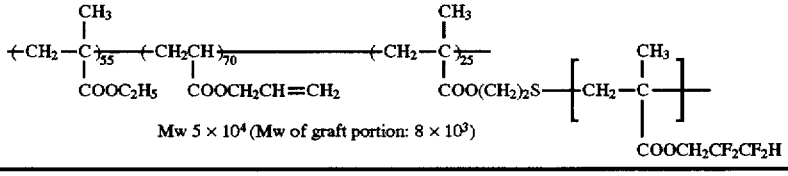 Mw 5 × $10^4$ (Mw of graft portion: 8 × $10^3$) |

(Note)
*b: bonded in the form of block

EXAMPLE 12

A mixture of 100 g of photoconductive zinc oxide (Sazex-2000 manufactured by Sakai Chemical Industry Co., Ltd.), 38 g of Binder Resin (B-7) having the structure shown below, 2 g of Binder Resin (B-8) having the structure shown below, 0.020 g of Methine Dye (D-2) having the structure shown below, 0.25 g of phthalic anhydride and 300 g of toluene was dispersed by a homogenizer (manufactured by Nippon Seiki K.K.) at a rotation of $9\times10^3$ r.p.m. for 15 minutes to prepare a dispersion for a light-sensitive layer.

Binder Resin (B-7)

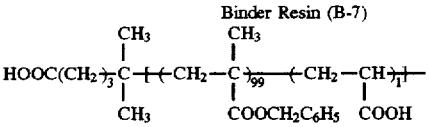

Mw $7\times10^4$

Binder Resin (B-8)

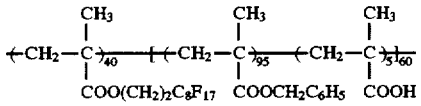

Mw $5\times10^4$

Methine Dye (D-2)

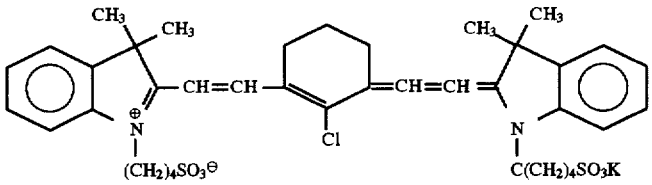

The resulting dispersion was coated on a support used for an electrophotographic lithographic printing plate precursor (ELP-IIX manufactured by Fuji Photo Film Co., Ltd.) by a wire bar at a dry coverage of 25 g/m$^2$, heated at 110° C. for one minute, and allowed to stand in a dark place under conditions of 20° C. and 65% RH for 24 hours to prepare an electrophotographic light-sensitive element.

Using the resulting electrophotographic light-sensitive element, a toner image was formed on a support for waterless lithographic printing plate in the same manner as in Example 1 except that the electrophotographic light-sensitive element was charged to −500 V with corona discharge. Liquid Developer (LD-2) was used for the development and a support for ELP-IX having provided thereon an adhesive layer having a thickness of 1.5 μm and the composition shown below was employed as the support for print plate.

| Composition of Adhesive Layer | |
|---|---|
| Resin (A-7) having the structure shown below | 95 parts by weight |
| Dimethoxydivinylsilane | 5 parts by weight |

Resin (A-7)

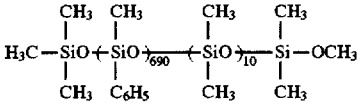

Then, a mixed solution of 6 g silicone rubber of addition type (KS774 manufactured by Shin-Etsu Silicone Co., Ltd.), 180 mg of CAT-PL-4 (manufactured by Shin-Etsu Silicone Co., Ltd.) and 34 g of heptane was coated on the whole support bearing the toner image by a wire bar and heated at 90° C. for 2 minutes to conduct drying and crosslinking, thereby forming a non-tacky resin layer having a thickness of 2.1 μm.

The removal of non-tacky resin layer in the image portion to prepare a lithographic printing plate and printing using the resulting plate were conducted in the same manner as in Example 1. More than 3,000 good prints of clear image without stain in the non-image portion were obtained.

EXAMPLE 13

A mixture of 1 g of X-form metal-free phthalocyanine (manufactured by Dainippon Ink and Chemicals, Inc.), 8.5 g of Binder Resin (B-9) having the structure shown below, 0.15 g of Compound (B) described above, and 80 g of tetrahydrofuran was put into a 500 ml-volume glass container together with glass beads and dispersed in a paint shaker (manufactured by Toyo Seiki Seisakusho Co.) for 60 minutes. To the dispersion were added 1.5 g of Binder Resin (B-10) having the structure shown below, 0.03 g of phthalic anhydride and 0.002 g of o-chlorophenol, followed by further dispersing for 2 minutes. The glass beads were separated by filtration to prepare a dispersion for a light-sensitive layer.

Binder Resin (B-9)

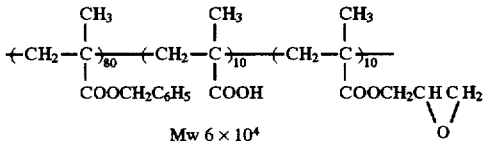

Mw $6\times10^4$

Binder Resin (B-10)

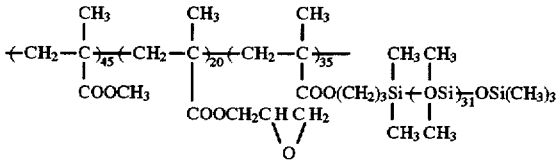

Mw 5 × 10⁴

The resulting dispersion was coated on an aluminum plate having a thickness of 0.2 mm, which had been subjected to degrease treatment, by a wire bar, set to touch, and heated in a circulating oven at 110° C. for 20 seconds, and then further heated at 140° C. for one hour to form a light-sensitive layer having a thickness of 8 μm. The adhesion of the surface of the resulting electrophotographic light-sensitive element was 8 g.f.

For comparison, an electrophotographic light-sensitive element was prepared in the same manner as described above except for eliminating 1.5 g of Binder Resin (B-10) and using 10 g of Binder Resin (B-9). The adhesion of the surface thereof was 420 g.f.

On the electrophotographic light-sensitive element having the surface of releasability was formed a toner image in the same manner as in Example 1 except for using Liquid Developer (LD-4) having the composition shown below in place of Liquid Developer (LD-1).

Liquid Developer (LD-4)

The same procedure as in the preparation of Liquid Developer (LD-1) was repeated except for using a mixture of 1.5 parts by weight of ethylene/methyl methacrylate (96/4 ratio by mole) copolymer, 2.5 parts by weight of Cyanine Blue SR5020 (manufactured by Dainichiseika Color & Chemicals Mfg., Co., Ltd.) and 12 parts by weight of Isopar L for kneading.

The toner image formed on the electrophotographic light-sensitive element was transferred onto an aluminum plate having a thickness of 150 μm a surface of which had been anodized and treated with a silicate by a pre-charge method same as in Example 1, and the remaining carrier liquid was removed by warm air of 50° C.

On the while aluminum support bearing the toner image was uniformly provided a non-tacky resin layer in the following manner.

Preparation of Donor Sheet D(S-1)

On a PET film having a thickness of 100 μm treated a surface thereof with polyvinyl acetate (manufactured by Fuji Photo Film Co., Ltd.) was coated a mixed solution of 6 g of silicon rubber of addition type for release paper (X56-A5730 manufactured by Toshiba Silicone Co., Ltd.) and 36 g of heptane by a wire bar and dried at 90° C. for 2 minutes to prepare a non-tacky resin layer having a thickness of 2.2 μm.

On the aluminum support bearing the toner image prepared above was coated a crosslinking agent (CM620 manufactured by Toshiba Silicone Co., Ltd.) at a coverage of 30 μg/cm² by a wire bar. Then Donor Sheet (DS-1) was superposed thereon so that the non-tacky resin layer was brought into contact with the layer of crosslinking agent on the support, and the laminate was passed between a pair of rollers adjusted at 90° C. at a nip pressure of 5 Kgf/cm² and a transportation speed of 40 cm/min. The PET film was then peeled off and the silicon rubber was cured to provide the non-tacky resin layer on the aluminum support.

The removal of non-tacky resin layer in the image portion to prepare a lithographic printing plate and printing using the resulting plate were conducted in the same manner as in Example 1. More than 50,000 good prints of highly accurate image without stain in the non-image portion were obtained.

EXAMPLE 14

A toner image was formed on a support for lithographic printing plate in the same manner as in Example 13 except for using a support for ELP-IIX having provided thereon an adhesive layer composed of Resin (A-8) having the structure shown below having a thickness of 0.5 μm in place of the surface-treated aluminum plate.

Resin (A-8)

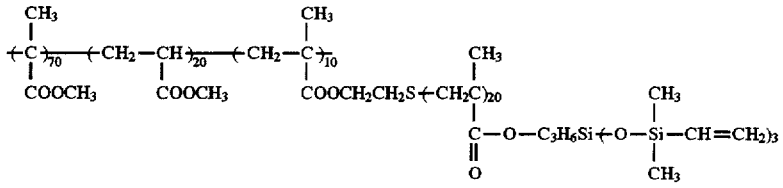

Mw 8.0 × 10⁴

Preparation of Donor Sheet (DS-2)

On release paper (San Release, manufactured by Sanyo Kokusaku Pulp K.K.) was coated a mixed solution of 3 g of silicon rubber of addition type (KS774 manufactured by Sin-Etsu Silicone Co., Ltd.), 3 g of silicon rubber of addition type (X56-A5730 manufactured by Toshiba Silicone Co., Ltd.) and 36 g of heptane by a wire bar, set to touch, and dried at 90° C. for 5 minutes to prepare a cured non-tacky resin layer having a thickness of 2.5 μm.

Donor Sheet (DS-2) was superposed on the support bearing the toner image described above so that the non-tacky resin layer of Donor Sheet (DS-2) was brought into contact with the adhesive layer of the support, and the laminate was passed between a pair of rollers adjusted at 90° C. at a nip pressure of 4.5 Kgf/cm² and a transportation speed of 20 cm/sec.

The release paper was then peeled off and the cured non-tacky resin layer was transferred on the support. The non-tacky resin layer was removed by brushing in the image portion to prepare a lithographic printing plate. Printing was conducted using the printing plate in the same manner as in Example 1. More than 10,000 good prints of highly accurate image without stain in the non-image portion were obtained.

EXAMPLE 15

A toner image was formed on a support for ELP-IIX having an adhesive layer composed of Resin (A-8) in the same manner as in Example 14.

Preparation of Donor Sheet (DS-3)

On a PET film having a thickness of 100 μm treated a surface thereof with polyvinyl acetate (manufactured by Fuji Photo Film Co., Ltd.) was coated a mixed solution of 6 g of silicone rubber of addition type (KS774 manufactured by Shin-Etsu Silicone Co., Ltd.), 180 mg of CAT-PL-4 (manufactured by Shin-Etsu Silicone Co., Ltd.) and 34 g of heptane by a wire bar and heated at 90° C. for 2 minutes to conduct drying and crosslinking, thereby forming a non-tacky resin layer having a thickness of 2.0 μm.

Donor Sheet (DS-3) was superposed on the support bearing the toner image described above so that the non-tacky resin layer of Donor Sheet (DS-3) was brought into contact with the adhesive layer of the support, and the laminate was passed between a pair of rollers adjusted at 110° C. at a nip pressure of 5 Kgf/cm$^2$ and a transportation speed of 20 cm/min.

The PET film was then peeled off at an angle of 150 degree and a speed of 10 cm/sec. The non-tacky resin layer of cured silicone rubber in the image portion was removed together with the PET film while remaining on the support in the non-image portion, whereby a lithographic printing plate was prepared.

This is because the non-tacky resin layer firmly adhered to the adhesive layer on the support in the non-image portions, while the non-tacky resin layer in the image portion did not substantially adhere to the support since the adhesive layer thereon was masked by the toner image.

Printing was conducted using the printing plate in the same manner in Example 1 and more than 10,000 good prints of clear image without stain in the non-image portion were obtained. Fine lines and letters on the prints were clear-cut in comparison with those in Example 13. It was found as a result of the observation using an electron microscope that the diagonal cut of the non-tacky resin layer at the edge of non-image portion due to the rubbing for removing the non-tacky resin layer in the image portion did not occur in the peel-apart method as described above.

EXAMPLE 16

A mixture of 5 g of a bisazo pigment having the structure shown below, 95 g of tetrahydrofuran and 5 g of a polyester resin (Vylon 200 manufactured by Toyobo Co., Ltd.) was thoroughly pulverized in a ball mill. The mixture was added to 520 g of tetrahydrofuran with stirring. The resulting dispersion was coated on a conductive transparent substrate same as described in Example 3 by a wire round rod to prepare a charge generating layer having a thickness of about 0.7 μm.

Bisazo Pigment

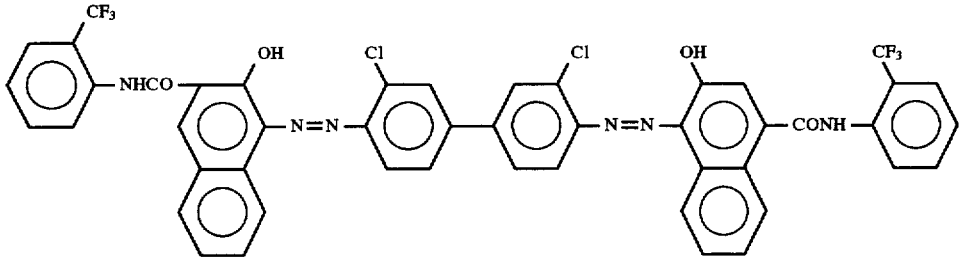

A mixed solution of 20 g of a hydrazone compound having the structure shown below, 30 g of a polycarbonate resin (Lexan 121 manufactured by General Electric Co., Ltd.) and 160 g of tetrahydrofuran was coated on the above-described charge generating layer by a wire round rod, dried at 60° C. for 30 seconds and then heated at 100° C. for 20 seconds to form a charge transporting layer having a thickness of about 18 μm whereby an electrophotographic light-sensitive element having a double-layered structure was prepared.

Hydrazone Compound

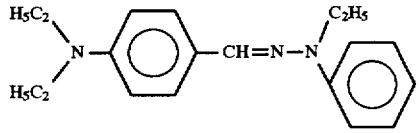

On the electrophotographic light-sensitive element thus-prepared was coated a mixed solution of 30 g of silicone adhesive of tack-free type at a normal temperature (TSR 1520[A] manufactured by Toshiba Silicone Co., Ltd., 300 mg of a crosslinking agent (TSR 1520[B] manufactured by Toshiba Silicone Co., Ltd.) and 90 g of heptane by a wire bar at a dry thickness of 5 μm, and heated in an oven at 125° C. for 2 minutes to cure. The adhesion of the surface of the resulting electrophotographic light-sensitive element was 3 g.f.

The electrophotographic light-sensitive element was charged to a surface potential of −500 V in a dark place and exposed imagewise using a helium-neon laser of 633 nm at an irradiation dose on the surface of the electrophotographic light-sensitive element of 30 erg/cm$^2$, followed by conducting the same procedure as in Example 3 to prepare a lithographic printing plate. As a result of printing using the resulting printing plate in the same manner as in Example 3, more than 50,000 good prints of highly accurate image without background stain similar to those in Example 3 were obtained.

EXAMPLE 17

Each lithographic printing plate was prepared and printing was conducted in the same manner as in Example 7 except for using each of the methods (1) to (4) for imparting releasability to the surface of amorphous silicon electrophotographic light-sensitive element in place of the dip method in a solution containing Compound (S-1). Good results similar to those in Example 7 were obtained.

(1) For imparting releasability to the electrophotographic light-sensitive element, a metering roll having a silicone rubber layer on the surface thereof was brought into contact with a bath containing an oil of Compound (S-2) having the structure shown below on one side and with the electrophotographic light-sensitive element on the other side and they were rotated at a circumferential speed of 15 mm/sec for 20 seconds. As a result, the adhesion of the surface of electrophotographic light-sensitive element became 5 g.f.

Compound (S-2)

Carboxy-modified silicone oil (TSF 4770 manufactured by Toshiba Silicone Co., Ltd.)

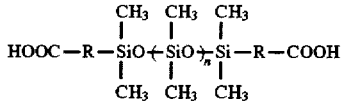

Further, a transfer roll having a styrene-butadiene rubber layer on the surface thereof was placed between the metering roll dipped in the silicone oil bath of Compound (S-2) and the electrophotographic light-sensitive element, and the treatment was conducted in the same manner as above. Good releasability of the surface of electrophotographic light-sensitive element similar to the above was obtained.

Moreover, in the above-described method of using the metering roll and transfer roll, Compound (S-2) was supplied between the metering roll and the transfer roll, and the treatment was conducted in the same manner as above. Again, good result similar to the above was obtained.

(2) An AW-treated felt (material: wool having a thickness of 15 mm and a width of 20 mm) impregnated uniformly with 2 g of Compound (S-3), i.e., dimethyl silicone oil (KF-96L-2.0 manufactured by Shin-Etsu Silicone Co., Ltd.) was pressed under a pressure of 200 g on the surface of electrophotographic light-sensitive element and the electrophotographic light-sensitive element was rotated at a circumferential speed of 20 mm/sec for 30 seconds. The adhesion of the surface of electrophotographic light-sensitive element thus-treated was 5 g.f.

(3) A rubber roller having a heating means integrated therein and covered with cloth impregnated with Compound (S-4), i.e., fluorine-containing surface active agent (Sarflon S-141 manufactured by Asahi Glass Co., Ltd.) was heated to a surface temperature of 60° C., then brought into contact with the electrophotographic light-sensitive element and they were rotated at a circumferential speed of 20 mm/sec for 30 seconds. The adhesion of the surface of electrophotographic light-sensitive element thus-treated was 12 g.f.

(4) A silicone rubber roller comprising a metal axis covered with silicone rubber (manufactured by Kinyosha K.K.) was pressed on the electrophotographic light-sensitive element at a nip pressure of 500 g.f/cm$^2$ and rotated at a circumferential speed of 15 mm/sec for 10 seconds. The adhesion of the surface of electrophotographic light-sensitive element thus-treated was 10 g.f.

While the invention has been described in detail and with reference to specific embodiments thereof, it will be apparent to one skilled in the art that various changes and modifications can be made therein without departing from the spirit and scope thereof.

What is claimed is:

1. A method for preparation of a waterless lithographic printing plate by an electrophotographic process comprising forming a non-fixing toner image by an electrophotographic process using a liquid developer on a surface of an electrophotographic light-sensitive element comprising an electrically conductive support having provided thereon a photoconductive layer; transferring the toner image onto a surface of a support for the lithographic printing plate; placing a non-tacky resin layer over the whole surface of the support for the lithographic printing plate bearing the toner image, the non-tacky resin having a greater force of adhesion to the surface of the support for the lithographic printing plate than the force of adhesion of the toner image to the surface of the support for the lithographic printing plate; and removing that portion of the non-tacky resin layer not directly adhered to the surface of the support for the lithographic printing plate.

2. A method for preparation of waterless lithographic printing plate by an electrophotographic process as claimed in claim 1, wherein a force necessary for releasing the non-tacky resin layer from the support for lithographic printing plate in the non-image portion is not less than 200 gram.force and a force necessary for removing the non-tacky resin layer from the support for lithographic printing plate in the image portion is not more than 20 gram.force.

3. A method for preparation of waterless lithographic printing plate by an electrophotographic process as claimed in claim 1, wherein the surface of electrophotographic light-sensitive element has an adhesion of not more than 200 grams.force.

4. A method for preparation of waterless lithographic printing plate by an electrophotographic process as claimed in claim 3, wherein the electrophotographic light-sensitive element comprises amorphous silicon as a photoconductive substance.

5. A method for preparation of waterless lithographic printing plate by an electrophotographic process as claimed in claim 3, wherein the electrophotographic light-sensitive element contains a polymer having a polymer component containing at least one of a silicon atom and a fluorine atom in the region near to the surface thereof.

6. A method for preparation of waterless lithographic printing plate by an electrophotographic process as claimed in claim 5, wherein the polymer is a block copolymer comprising at least one polymer segment ($\alpha$) containing at least 50% by weight of a fluorine atom and/or silicon atom-containing polymer component and at least one polymer segment ($\beta$) containing 0 to 20% by weight of a fluorine atom and/or silicon atom-containing polymer component, the polymer segments ($\alpha$) and ($\beta$) being bonded in the form of blocks.

7. A method for preparation of waterless lithographic printing plate by an electrophotographic process as claimed in claim 5, wherein the polymer further contains a polymer component containing a photo-and/or heat-curable group.

8. A method for preparation of waterless lithographic printing plate by an electrophotographic process as claimed in claim 6, wherein the polymer further contains a polymer component containing a photo-and/or heat-curable group.

9. A method for preparation of waterless lithographic printing plate by an electrophotographic process as claimed in claim 3, wherein the electrophotographic light-sensitive element is an electrophotographic light-sensitive element to the surface of which a compound (S) which contains a fluorine atom and/or a silicon atom has been applied.

10. A method for preparation of waterless lithographic printing plate by an electrophotographic process as claimed in claim 1, wherein a surface of the non-tacky resin layer has a surface energy of not more than 30 erg.cm$^{-1}$.

11. A method for preparation of waterless lithographic printing plate by an electrophotographic process as claimed in claim 10, wherein the non-tacky resin layer contains a silicone resin.

12. A method for preparation of waterless lithographic printing plate by an electrophotographic process as claimed in claim 10, wherein the non-tacky resin layer contains a fluorinated resin.

13. A method for preparation of waterless lithographic printing plate by an electrophotographic process as claimed in claim 11, wherein the silicone resin is a polymer composed of an organo siloxane repeating unit represented by the following general formula (I):

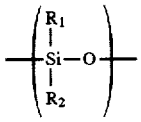

(I)

wherein $R_1$ and $R_2$, which may be the same or different, each represents an aliphatic or aromatic hydrocarbon group or a heterocyclic group.

14. A method for preparation of waterless lithographic printing plate by an electrophotographic process as claimed in claim 1, wherein the non-tacky resin layer is cured.

15. A method for preparation of waterless lithographic printing plate by an electrophotographic process as claimed in claim 1, wherein a chemical bond is formed at the interface between the support for lithographic printing plate and the non-tacky resin layer in the non-image portion.

16. A method for preparation of waterless lithographic printing plate by an electrophotographic process as claimed in claim 1, wherein the toner image is not fixed.

17. A method for preparation of waterless lithographic printing plate by an electrophotographic process as claimed in claim 1, wherein the removal of the non-tacky resin layer in the image portion is conducted by a dry process.

18. A method for preparation of waterless lithographic printing plate by an electrophotographic process as claimed in claim 1, wherein both the toner image and the non-tacky resin layer provided thereon are removed from the support for lithographic printing plate.

* * * * *